US012791191B2

(12) United States Patent
Yu et al.

(10) Patent No.: US 12,791,191 B2
(45) Date of Patent: Nov. 10, 2026

(54) ANNULAR VORTEX COMBUSTOR FOR A TURBINE ENGINE

(71) Applicant: General Electric Company, Evendale, OH (US)

(72) Inventors: Rachel Yu, Medford, MA (US); Nicholas R. Overman, Sharonville, OH (US); William David Magnuszewski, Cincinnati, OH (US)

(73) Assignee: GENERAL ELECTRIC COMPANY, Evendale, OH (US)

( * ) Notice: Subject to any disclaimer, the term of this patent is extended or adjusted under 35 U.S.C. 154(b) by 0 days.

(21) Appl. No.: 19/173,152

(22) Filed: Apr. 8, 2025

(65) Prior Publication Data

US 2026/0309330 A1 Oct. 8, 2026

(51) Int. Cl.

| | |
|---|---|
| ***F23R 3/58*** | (2006.01) |
| ***F23R 3/12*** | (2006.01) |
| ***F23R 3/28*** | (2006.01) |
| ***F23R 3/34*** | (2006.01) |

(52) U.S. Cl.

CPC ..... *F23R 3/58* (2013.01); *F23R 3/12* (2013.01); *F23R 3/28* (2013.01); *F23R 3/346* (2013.01); *F23R 2900/03042* (2013.01)

(58) Field of Classification Search

CPC .... F23R 3/18; F23R 3/34; F23R 3/346; F23R 3/58; F23R 3/50

See application file for complete search history.

(56) References Cited

U.S. PATENT DOCUMENTS

| | | | | |
|---|---|---|---|---|
| 2,933,895 A | | 4/1960 | Cheeseman | |
| 3,820,324 A | | 6/1974 | Grindley et al. | |
| 3,869,864 A | * | 3/1975 | Bunn | F23R 3/12 60/749 |
| 4,062,182 A | | 12/1977 | Fehler et al. | |

(Continued)

FOREIGN PATENT DOCUMENTS

| | | | |
|---|---|---|---|
| EP | 4692645 | A1 | 2/2026 |
| EP | 4700291 | A1 | 2/2026 |
| WO | 2018/190926 | A1 | 10/2018 |

OTHER PUBLICATIONS

Overman et al., U.S. Appl. No. 18/633,110, filed Apr. 11, 2024.
Yu et al., U.S. Appl. No. 18/677,200, filed May 29, 2024.

*Primary Examiner* — Gerald L Sung
(74) *Attorney, Agent, or Firm* — Venable LLP; Peter T. Hrubiec; Michele V. Frank

(57) ABSTRACT

An annular vortex combustor for a turbine engine. The annular vortex combustor defines a forward end and an aft end. The annular vortex combustor includes a combustor liner and a combustion chamber. The combustor liner includes an outer liner, an inner liner, and a dome at the forward end. The dome has a generally arc shape and extends from the outer liner to the inner liner. The combustion chamber is defined by the outer liner, the inner liner, and the dome, and extends from the forward end to the aft end. The combustion chamber has a primary combustion zone defined by the dome. The combustion chamber is configured to combust a mixture of a fuel flow and a compressed air flow in the primary combustion zone to generate a primary zone vortex, the generally arc shape of the dome shaping the primary zone vortex.

20 Claims, 12 Drawing Sheets

(56) References Cited

U.S. PATENT DOCUMENTS

| | | | | | |
|---|---|---|---|---|---|
| 4,545,196 | A * | 10/1985 | Mongia | F23R 3/26 | 60/39.23 |
| 4,702,073 | A * | 10/1987 | Melconian | F23R 3/06 | 60/39.464 |
| 4,996,838 | A * | 3/1991 | Melconian | F23R 3/58 | 60/755 |
| 5,025,622 | A * | 6/1991 | Melconian | F23R 3/50 | 60/39.464 |
| 5,165,226 | A * | 11/1992 | Newton | F23R 3/12 | 60/750 |
| 5,265,425 | A | 11/1993 | Howell | | |
| 6,427,447 | B1 * | 8/2002 | Sowa | F23D 14/62 | 60/737 |
| 6,497,103 | B2 | 12/2002 | Johnson et al. | | |
| 6,951,108 | B2 | 10/2005 | Burrus et al. | | |
| 8,272,219 | B1 | 9/2012 | Johnson et al. | | |
| 11,703,225 | B2 | 7/2023 | Singh et al. | | |
| 11,788,725 | B2 | 10/2023 | Duncan et al. | | |
| 11,828,469 | B2 | 11/2023 | Overman et al. | | |
| 11,920,791 | B1 * | 3/2024 | Overman | F23R 3/54 | |
| 2005/0229604 | A1 * | 10/2005 | Chen | F23R 3/54 | 60/776 |
| 2007/0271925 | A1 * | 11/2007 | Alkabie | F23R 3/50 | 60/752 |
| 2010/0162710 | A1 * | 7/2010 | Senior | F23R 3/34 | 60/737 |
| 2012/0023964 | A1 * | 2/2012 | Mehring | F23R 3/30 | 60/737 |
| 2012/0067051 | A1 * | 3/2012 | Oechsle | F23R 3/16 | 60/740 |
| 2013/0174559 | A1 * | 7/2013 | Mehring | F23R 3/54 | 60/737 |
| 2015/0121886 | A1 | 5/2015 | McCormick et al. | | |
| 2019/0086092 | A1 * | 3/2019 | Boardman | F23R 3/18 | |
| 2019/0120491 | A1 * | 4/2019 | Boardman | F23R 3/58 | |
| 2020/0158342 | A1 | 5/2020 | Boardman et al. | | |
| 2022/0090788 | A1 | 3/2022 | Duncan et al. | | |

* cited by examiner

ANNULAR VORTEX COMBUSTOR FOR A TURBINE ENGINE

TECHNICAL FIELD

The present disclosure relates generally to an annular vortex combustor, for example, in a turbine engine.

BACKGROUND

Turbine engines, for example, for an aircraft, generally include a propulsor (e.g., a fan or a propeller) and a turbo-engine arranged in flow communication with one another. The turbo-engine includes a compressor section, a combustion section, and a turbine section. The combustion section includes a combustor for generating combustion products.

BRIEF DESCRIPTION OF THE DRAWINGS

Features and advantages will be apparent from the following, more particular, description of various exemplary embodiments, as illustrated in the accompanying drawings, wherein like reference numbers generally indicate identical, functionally similar, and/or structurally similar elements.

DETAILED DESCRIPTION

Figure 1:
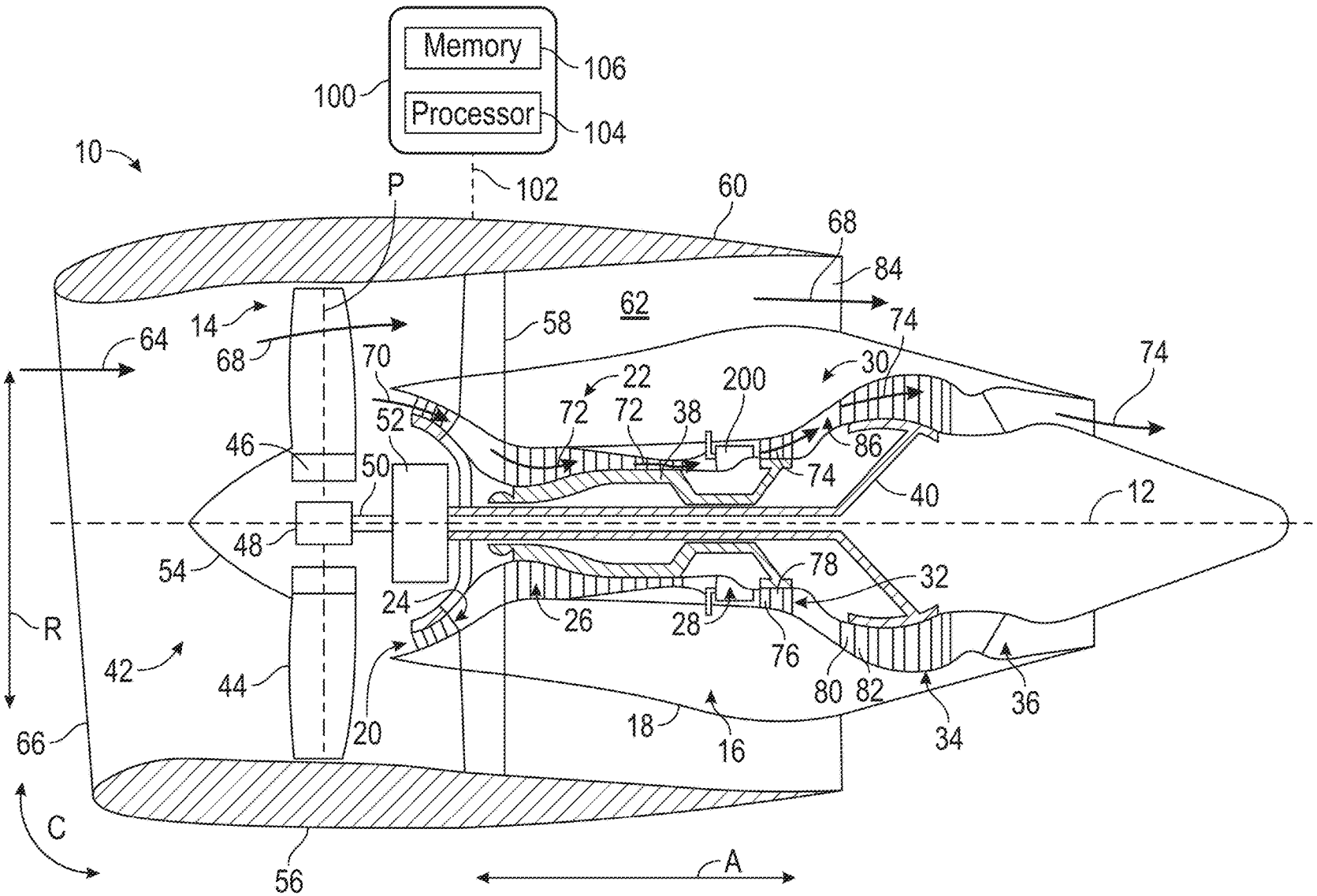
FIG. 1 illustrates a schematic, cross-sectional view of a gas turbine engine, taken along a longitudinal centerline axis of the engine, according to the present disclosure.

Features, advantages, and embodiments of the present disclosure are set forth or apparent from a consideration of the following detailed description, drawings, and claims. Moreover, the following detailed description is exemplary and intended to provide further explanation without limiting the scope of the disclosure as claimed.

Various embodiments of the present disclosure are discussed in detail below. While specific embodiments are discussed, this is done for illustration purposes only. A person skilled in the relevant art will recognize that other components and configurations may be used without departing from the present disclosure.

As used herein, the terms "first," "second," and the like, may be used interchangeably to distinguish one component from another and are not intended to signify location or importance of the individual components.

The terms "upstream" and "downstream" refer to the relative direction with respect to fluid flow in a fluid pathway. For example, "upstream" refers to the direction from which the fluid flows, and "downstream" refers to the direction to which the fluid flows.

The terms "forward" and "aft" refer to relative positions within a turbine engine or vehicle, and refer to the normal operational attitude of the turbine engine or vehicle (e.g., an aircraft) with respect to a direction of travel. More particularly, forward and aft are used herein with reference to a direction of travel of the vehicle and a direction of propulsive thrust of the gas turbine engine.

As used herein, the terms "low," "mid" (or "mid-level"), and "high," or their respective comparative degrees (e.g., "lower" and "higher", where applicable), when used with compressor, turbine, shaft, fan, or turbine engine components, each refers to relative pressures, relative speeds, relative temperatures, and/or relative power outputs within an engine unless otherwise specified. For example, a "low power" setting defines the engine configured to operate at a power output lower than a "high power" setting of the engine, and a "mid-level power" setting defines the engine configured to operate at a power output higher than a "low power" setting and lower than a "high power" setting. The terms "low," "mid" (or "mid-level"), or "high" in such aforementioned terms may additionally, or alternatively, be understood as relative to minimum allowable speeds, pressures, or temperatures, or minimum or maximum allowable speeds, pressures, or temperatures relative to normal, desired, steady state, etc., operation of the engine.

The terms "coupled," "fixed," "attached," "connected," and the like, refer to both direct coupling, fixing, attaching, or connecting, as well as indirect coupling, fixing, attaching, or connecting through one or more intermediate components or features, unless otherwise specified herein. The terms include integral and unitary configurations (e.g., blisk rotor blade systems).

The singular forms "a," "an," and "the" include plural references unless the context clearly dictates otherwise.

As used herein, the terms "axial" and "axially" refer to directions and orientations that extend substantially parallel to a centerline of the turbine engine. Moreover, the terms "radial" and "radially" refer to directions and orientations that extend substantially perpendicular to the centerline of the turbine engine. In addition, as used herein, the terms "circumferential" and "circumferentially" refer to directions and orientations that extend arcuately about the centerline of the turbine engine.

Approximating language, as used herein throughout the specification and claims, is applied to modify any quantitative representation that could permissibly vary without resulting in a change in the basic function to which it is related. Accordingly, a value modified by a term or terms, such as "about," "approximately," "generally," and "substantially" is not to be limited to the precise value specified. In at least some instances, the approximating language may correspond to the precision of an instrument for measuring the value, or the precision of the methods or the machines for constructing the components and/or the systems or manufacturing the components and/or the systems. For example, the approximating language may refer to being within a one, two, four, ten, fifteen, or twenty percent margin in either individual values, range(s) of values and/or endpoints defining range(s) of values.

Here and throughout the specification and claims, range limitations are combined, and interchanged. Such ranges are identified and include all the sub-ranges contained therein unless context or language indicates otherwise. For example, all ranges disclosed herein are inclusive of the endpoints, and the endpoints are independently combinable with each other.

The present disclosure provide a combustor having a primary combustion zone with a primary zone vortex in the primary combustion zone. The combustor has a combustor liner that is contoured at an upstream end of the combustor to help shape the primary zone vortex. Driver openings that introduce a driver flow into the combustor help to shape and to maintain the primary zone vortex within the combustor. Thus, the combustor is an annular vortex combustor. In some embodiments, the combustor liner includes an inner liner and an outer liner that are contoured to help shape a primary zone vortex and to shape a secondary zone vortex that is axially downstream of the primary zone vortex. In some embodiments, two counter rotating vortices are created by primary driver openings and secondary driver openings. In some embodiments, two vortices are created in a secondary combustion zone of the combustor to increase mixing and residence time. The vortices in the combustor are untrapped vortices, meaning that there is no physical structure maintaining the vortices within the combustion zones. Rather, the vortices are maintained by the driver flow and a cooling flow introduced into the combustor. Accordingly, the annular vortex combustor having the vortices therein increases residence time and mixing of the combustion process, which reduces pattern factor and emissions, as compared to combustors without the benefit of the present disclosure. The pattern factor is a measure of a maximum temperature at the combustor exit. In particular, the pattern factor is a nondimensional temperature that relates to a peak local temperature at the combustor exit to the combustor inlet temperature and the average exit temperature. The pattern factor, also referred to as a peak temperature factor, is an indicator of the magnitude and the location of a hot streak in the combustor.

Such a configuration of the combustor allows the combustor to have a lesser axial length as compared to combustors without the benefit of the present disclosure. Further, the annular vortex combustor of the present disclosure provides the following: (1) axially positioned vortices, unlike current combustors that have radially stacked vortices, (2) a primary zone vortex shaped by a rounded dome for a multi-purpose of shaping vortical flow structure, providing back-side cooling of the dome, and guiding flow to passages with reduced loss, unlike current combustors in which the flow reaches stagnation or near stagnation at the dome face, and require a cowl to guide the flow into passages or have a great amount of pressure losses into the passage due to a lack of a cowl, (3) the inner driver openings and the outer driver openings being axially staggered from each other to form two or more counter rotating toroidal vortices, (4) driver openings can be angled tangentially or circumferentially to provide bulk swirl to the flow, and (5) the bulk swirl can also be achieved by reducing de-swirler in a compressor outlet guide vane, also reducing total system loss between an exit of the compressor and the combustor.

Referring now to the drawings, FIG. 1 is a schematic, cross-sectional view of a turbine engine 10, taken along a longitudinal centerline axis 12 of the turbine engine 10, according to an embodiment of the present disclosure. As shown in FIG. 1, the turbine engine 10 defines an axial direction A (extending parallel to the longitudinal centerline axis 12 provided for reference), a radial direction R that is normal to the axial direction A, and a circumferential direction C extending about the longitudinal centerline axis 12. In general, the turbine engine 10 includes a fan section 14 and a turbo-engine 16 disposed downstream from the fan section 14.

The turbo-engine 16 includes, in serial flow relationship, a compressor section 22, a combustion section 28, and a turbine section 30. The turbo-engine 16 is substantially enclosed with an outer casing 18 that is substantially tubular and defines an annular inlet 20. As schematically shown in FIG. 1, the compressor section 22 includes a booster or a low-pressure (LP) compressor 24 followed downstream by a high-pressure (HP) compressor 26. The combustion section 28 includes an annular vortex combustor 200 and is downstream of the compressor section 22. The turbine section 30 is downstream of the combustion section 28 and includes a high-pressure (HP) turbine 32 followed downstream by a low-pressure (LP) turbine 34. The turbo-engine 16 further includes a jet exhaust nozzle section 36 that is downstream of the turbine section 30, a high-pressure (HP) shaft 38 or an HP spool, and a low-pressure (LP) shaft 40 or an LP spool. The HP shaft 38 drivingly connects the HP turbine 32 to the HP compressor 26. The HP turbine 32 and the HP compressor 26 rotate in unison through the HP shaft 38. The LP shaft 40 drivingly connects the LP turbine 34 to the LP compressor 24. The LP turbine 34 and the LP compressor 24 rotate in unison through the LP shaft 40. The compressor section 22, the combustion section 28, the turbine section 30, and the jet exhaust nozzle section 36 together define a core air flow path.

For the embodiment depicted in FIG. 1, the fan section 14 includes a fan 42 (e.g., a variable pitch fan) having a plurality of fan blades 44 coupled to a disk 46 in a spaced apart manner. As depicted in FIG. 1, the fan blades 44 extend outwardly from the disk 46 generally along the radial direction R. In the case of a variable pitch fan, the plurality of fan blades 44 are rotatable relative to the disk 46 about a pitch axis P by virtue of the fan blades 44 being operatively coupled to an actuation member 48 configured to collectively vary the pitch of the fan blades 44 in unison. The fan blades 44, the disk 46, and the actuation member 48 are together rotatable about the longitudinal centerline axis 12 via a fan shaft 50 that is powered by the LP shaft 40 across a power gearbox, also referred to as a gearbox assembly 52.

In this way, the fan 42 is drivingly coupled to, and powered by, the turbo-engine 16, and the turbine engine 10 is an indirect drive engine. The gearbox assembly 52 is shown schematically in FIG. 1. The gearbox assembly 52 is a reduction gearbox assembly for adjusting the rotational speed of the fan shaft 50 and, thus, the fan 42 relative to the LP shaft 40 when power is transferred from the LP shaft 40 to the fan shaft 50.

Referring still to the exemplary embodiment of FIG. 1, the disk 46 is covered by a rotatable fan hub 54 aerodynamically contoured to promote an airflow through the plurality of fan blades 44. In addition, the fan section 14 includes an annular fan casing or a nacelle 56 that circumferentially surrounds the fan 42 and at least a portion of the turbo-engine 16 by a plurality of outlet guide vanes 58 that are circumferentially spaced about the nacelle 56 and the turbo-engine 16. Moreover, a downstream section 60 of the nacelle 56 extends over an outer portion of the turbo-engine 16, and, with the outer casing 18, defines a bypass airflow passage 62 therebetween.

During operation of the turbine engine 10, a volume of air 64 enters the turbine engine 10 through an inlet 66 of the nacelle 56 or the fan section 14. As the volume of air 64 passes across the fan blades 44, a first portion of air, also referred to as bypass air 68, is routed into the bypass airflow passage 62, and a second portion of air, also referred to as core air 70, is routed into the upstream section of the core air flow path through the annular inlet 20 of the LP compressor 24. The ratio between the bypass air 68 and the core air 70 is commonly known as a bypass ratio. The pressure of the core air 70 is then increased, generating compressed air 72. The compressed air 72 is routed through the HP compressor 26 and into the combustion section 28, wherein the compressed air 72 is mixed with fuel and ignited to generate combustion gases 74.

The combustion gases 74 are routed into the HP turbine 32 and expanded through the HP turbine 32 where a portion of thermal energy and kinetic energy from the combustion gases 74 is extracted via one or more stages of HP turbine stator vanes 76 and HP turbine rotor blades 78 that are coupled to the HP shaft 38. This causes the HP shaft 38 to rotate, thus, supporting operation of the HP compressor 26 (self-sustaining cycle). In this way, the combustion gases 74 do work on the HP turbine 32. The combustion gases 74 are then routed into the LP turbine 34 and expanded through the LP turbine 34. Here, a second portion of thermal energy and the kinetic energy is extracted from the combustion gases 74 via one or more stages of LP turbine stator vanes 80 and LP turbine rotor blades 82 that are coupled to the LP shaft 40. This causes the LP shaft 40 to rotate, thus, supporting operation of the LP compressor 24 (self-sustaining cycle) and rotation of the fan 42 via the gearbox assembly 52. In this way, the combustion gases 74 do work on the LP turbine 34.

The combustion gases 74 are subsequently routed through the jet exhaust nozzle section 36 of the turbo-engine 16 to provide propulsive thrust. Simultaneously, the bypass air 68 is routed through the bypass airflow passage 62 before being exhausted from a fan nozzle exhaust section 84 of the turbine engine 10, also providing propulsive thrust. The HP turbine 32, the LP turbine 34, and the jet exhaust nozzle section 36 at least partially define a hot gas path 86 for routing the combustion gases 74 through the turbo-engine 16.

The turbine engine 10 may be communicatively and operatively coupled to an engine controller 100 along a communication line 102. The engine controller 100 is configured to operate various aspects of the turbine engine 10. The engine controller 100 may be a Full Authority Digital Engine Control (FADEC). In this embodiment, the engine controller 100 is a computing device having a processor 104 and a memory 106. The processor 104 may be any suitable processing device, including, but not limited to, a microprocessor, a microcontroller, an integrated circuit, a logic device, a programmable logic controller (PLC), an application-specific integrated circuit (ASIC), and/or a Field Programmable Gate Array (FPGA). The memory 106 may include one or more computer-readable media, including, but not limited to, non-transitory computer-readable media, a computer-readable non-volatile medium (e.g., a flash memory), a RAM, a ROM, hard drives, flash drives, and/or other memory devices.

The memory 106 may store information accessible by the processor 104, including computer-readable instructions that may be executed by the processor 104. The instructions may be any set of instructions or a sequence of instructions that, when executed by the processor 104, causes the processor 104 and the engine controller 100 to perform operations. In some embodiments, the instructions may be executed by the processor 104 to cause the processor 104 to complete any of the operations and functions for which the engine controller 100 is configured, as will be described further below. The instructions may be software written in any suitable programming language, or may be implemented in hardware. Additionally, and/or alternatively, the instructions may be executed in logically and/or virtually separate threads on the processor 104. The memory 106 may further store data that may be accessed by the processor 104.

The technology discussed herein makes reference to computer-based systems and actions taken by, and information sent to and from, computer-based systems. One of ordinary skill in the art will recognize that the inherent flexibility of computer-based systems allows for a great variety of possible configurations, combinations, and divisions of tasks and functionality between components and among components. For instance, processes discussed herein may be implemented using a single computing device or multiple computing devices working in combination. Databases, memory, instructions, and applications may be implemented on a single system or distributed across multiple systems. Distributed components may operate sequentially or in parallel.

The engine controller 100 may be communicatively coupled to one or more sensors employed in the methods of the present disclosure, such as, for example, vibration sensors (such as accelerometers), temperature sensors, speed sensors, and other sensors within the turbine engine 10. For example, the engine controller 100 may receive, and optionally store or record, data or information from the one or more sensors. The engine controller 100 may also control motoring of the turbine engine (e.g., rotation of the rotor described in more detail to follow).

The turbine engine 10 depicted in FIG. 1 is by way of example only. In other exemplary embodiments, the turbine engine 10 may have any other suitable configuration. For example, in other exemplary embodiments, the fan 42 may be configured in any other suitable manner (e.g., as a variable pitch fan or a fixed pitch fan) and further may be supported using any other suitable fan frame configuration. Moreover, in other exemplary embodiments, any other suitable number or configuration of compressors, turbines, shafts, or a combination thereof may be provided. In other exemplary embodiments, the engine may also be a direct drive engine, which does not have a power gearbox (e.g., no gearbox assembly 52). The fan speed is the same as the LP shaft speed for a direct drive engine. In still other exemplary embodiments, aspects of the present disclosure may be incorporated into any other suitable turbine engine, such as, for example, turbofan engines, propfan engines, turboprop engines, unducted engines, or turboshaft engines.

Figure 2:
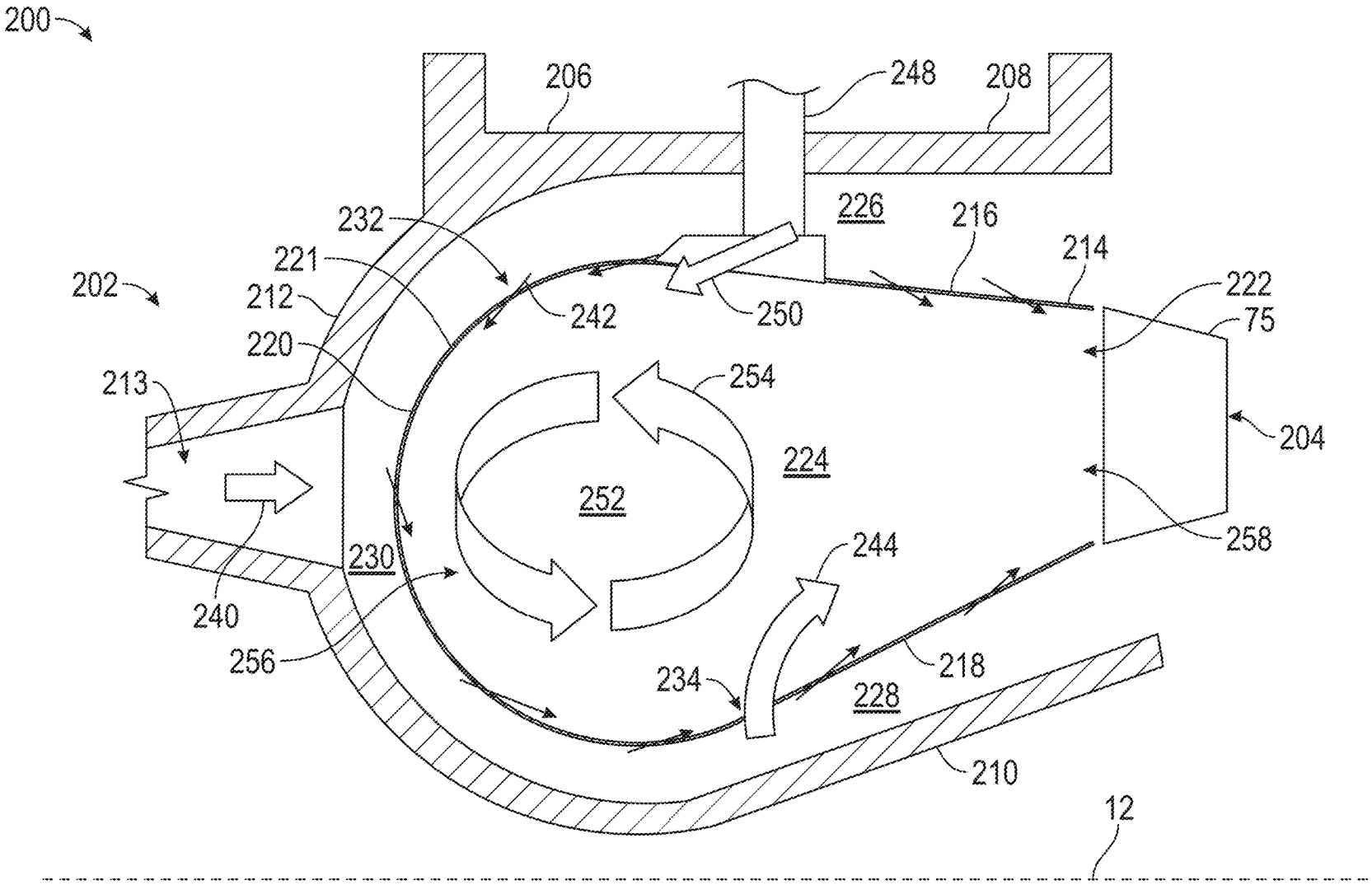
FIG. 2 illustrates a schematic, cross-sectional view of an annular vortex combustor for the turbine engine of FIG. 1, taken along a longitudinal centerline axis of the annular vortex combustor, according to the present disclosure.

FIG. 2 illustrates a schematic, cross-sectional view of the annular vortex combustor 200 taken along the longitudinal centerline axis 12. The annular vortex combustor 200 is annular about the longitudinal centerline axis 12 and includes a single primary zone vortex. The annular vortex combustor 200 has a forward end 202 and an aft end 204. The annular vortex combustor 200 includes a combustor casing 206 and a combustor liner 214. The combustor casing 206 has an outer casing 208, an inner casing 210, and a forward end 212. The annular vortex combustor 200 includes a diffuser inlet 213 defined at an upstream end (e.g., the forward end 202) of the annular vortex combustor 200. In particular, the combustor casing 206 defines the diffuser inlet 213 between the outer casing 208 and the inner casing 210.

The combustor liner 214 has an outer liner 216, an inner liner 218, a forward end 220, and an aft end 222. A combustion chamber 224 is formed within the combustor liner 214. More specifically, the outer liner 216 and the inner liner 218 are disposed between the outer casing 208 and the inner casing 210. The outer liner 216 and the inner liner 218 are spaced radially from each other such that the combustion chamber 224 is defined therebetween. The outer casing 208 and the outer liner 216 form an outer passage 226 therebetween, and the inner casing 210 and the inner liner 218 form an inner passage 228 therebetween. A forward passage 230 connecting the outer passage 226 and the inner passage 228 is formed between the forward end 212 and the forward end 220.

The forward end 220 defines a dome 221. The dome 221 defines a boundary of the combustion chamber 224 at the forward end 220. The dome 221 is generally arc shaped such that the dome 221 is curved about a center point from the outer liner 216 to the inner liner 218. In particular, the dome 221 has a generally semi-circular shape such that the dome 221 is an arc that measures approximately one hundred eighty degrees (180°). Such a configuration helps to generate and to maintain a vortex within the combustion chamber 224, as detailed further below. A radius of the inner liner 218 defined from the longitudinal centerline axis 12 (FIG. 1) to the inner liner 218 increases as the inner liner 218 extends axially from the dome 221 to a downstream end of the annular vortex combustor 200 (e.g., the aft end 222). In this way, a volume of the combustion chamber 224 decreases from the upstream end (e.g., the forward end 220) to the downstream end (e.g., the aft end 222). Particularly, the volume of the combustion chamber 224 is greatest at a primary combustion zone 252 and decreases downstream of the primary combustion zone 252.

The combustor liner 214 includes a plurality of liner cooling holes 232 and one or more driver openings 234. As noted above, the annular vortex combustor 200 receives compressed air from the compressor section 22 (FIG. 1). The compressed air from the compressor section 22 flows into the annular vortex combustor 200 as a compressed air flow 240 through the diffuser inlet 213. In particular, the diffuser inlet 213 is oriented to direct the compressed air flow 240 axially into the annular vortex combustor 200. The compressed air flow 240 enters the combustion chamber 224 through the plurality of liner cooling holes 232 as a cooling flow 242. The compressed air flow 240 also enters the combustion chamber 224 through the one or more driver openings 234 as a driver flow 244. Although a single driver opening of the one or more driver openings 234 is illustrated, the one or more driver openings 234 can include a plurality of driver openings spaced circumferentially about the longitudinal centerline axis 12.

The annular vortex combustor 200 includes a fuel nozzle assembly 248 that provides a fuel flow 250 into the combustion chamber 224. The fuel flow 250 and the compressed air flow 240 enter the annular vortex combustor 200 at an upstream end 256 and are ignited to combust within the primary combustion zone 252 of the combustion chamber 224 to generate a primary zone vortex 254. Although illustrated as rotating in a counterclockwise direction, the primary zone vortex 254 may rotate in a clockwise direction. The primary combustion zone 252 is defined between the forward end 220 of the combustor liner 214 and the one or more driver openings 234. That is, the primary combustion zone 252 is upstream of the one or more driver openings 234. As illustrated in FIG. 2, the annular vortex combustor 200 is arranged such that the forward end 202 of the annular vortex combustor 200 forms, with respect to the flow, the upstream end 256 of the combustion chamber 224, and the aft end 204 of the annular vortex combustor 200 forms, with respect to the flow, a downstream end 258 of the combustion chamber 224, thus, defining an annular vortex combustor.

During operation, the compressed air flow 240 flows through the plurality of liner cooling holes 232 to provide liner cooling and film cooling along the inner wall of the combustor liner 214. The compressed air flow 240 also flows through the one or more driver openings 234 into the combustion chamber 224. The air flowing through the one or more driver openings 234 drives the primary zone vortex 254. The air flowing through the one or more driver openings 234 creates an air wall or air curtain that maintains the primary zone vortex 254 in the primary combustion zone 252. The air wall prevents the air from escaping from the primary combustion zone 252, which assists in driving the primary zone vortex 254. That is, the sizing, the location, and the orientation (e.g., the angle at which the driver openings 234 are oriented) of the one or more driver openings 234 is such that the air flow (e.g., driver flow 244) reinforces the primary zone vortex 254 and assists in keeping the primary zone vortex 254 spinning or rotating within the primary combustion zone 252. The sizing of the driver openings 234 affects the amount of air flow therethrough and is selected to provide an amount of air flow into the primary combustion zone 252 that will sustain the amount of swirl in the primary combustion zone 252.

The air flowing through the plurality of liner cooling holes 232 and the fuel flow 250 also help to drive the primary zone vortex 254. In particular, the plurality of liner cooling holes 232 that extend through the dome 221 is angled with respect to the dome 221 to direct the cooling flow 242 substantially tangentially with respect to the dome 221. Similarly, the fuel nozzle assembly 248 injects the fuel flow 250 substantially tangentially with respect to the combustor liner 214. In particular, the fuel nozzle assembly 248 is positioned downstream of the dome 221 and injects the fuel flow 250 in an upstream direction towards the dome 221. The dome 221 directs the fuel flow 250 such that the fuel flow 250 helps to drive and to maintain the primary zone vortex 254. The primary zone vortex 254 mixes the fuel flow 250 with the cooling flow 242 to generate a fuel-air mixture that is ignited to generate the combustion gases 74 (FIG. 1).

The one or more driver openings 234 are oriented at an angle such that the driver flow 244 enters the combustion chamber 224 in a downstream direction. The driver flow 244 also provides an air curtain for the primary zone vortex 254, but also assists in pulling the flow of the combustion gases 74 (FIG. 1) downstream from the primary combustion zone 252 within the combustion chamber 224 towards the downstream end 258. In this way, the primary zone vortex 254 is an untrapped vortex, meaning that there is no physical structure maintaining the primary zone vortex 254 within the primary combustion zone 252. Rather, the cooling flow 242 and the driver flow 244 maintains the primary zone vortex 254. The combustion chamber 224 directs the combustion gases 74 (FIG. 1) to the turbine section 30 (FIG. 1) through a first stage nozzle 75 of the turbine section 30 (FIG. 1).

Figure 3:
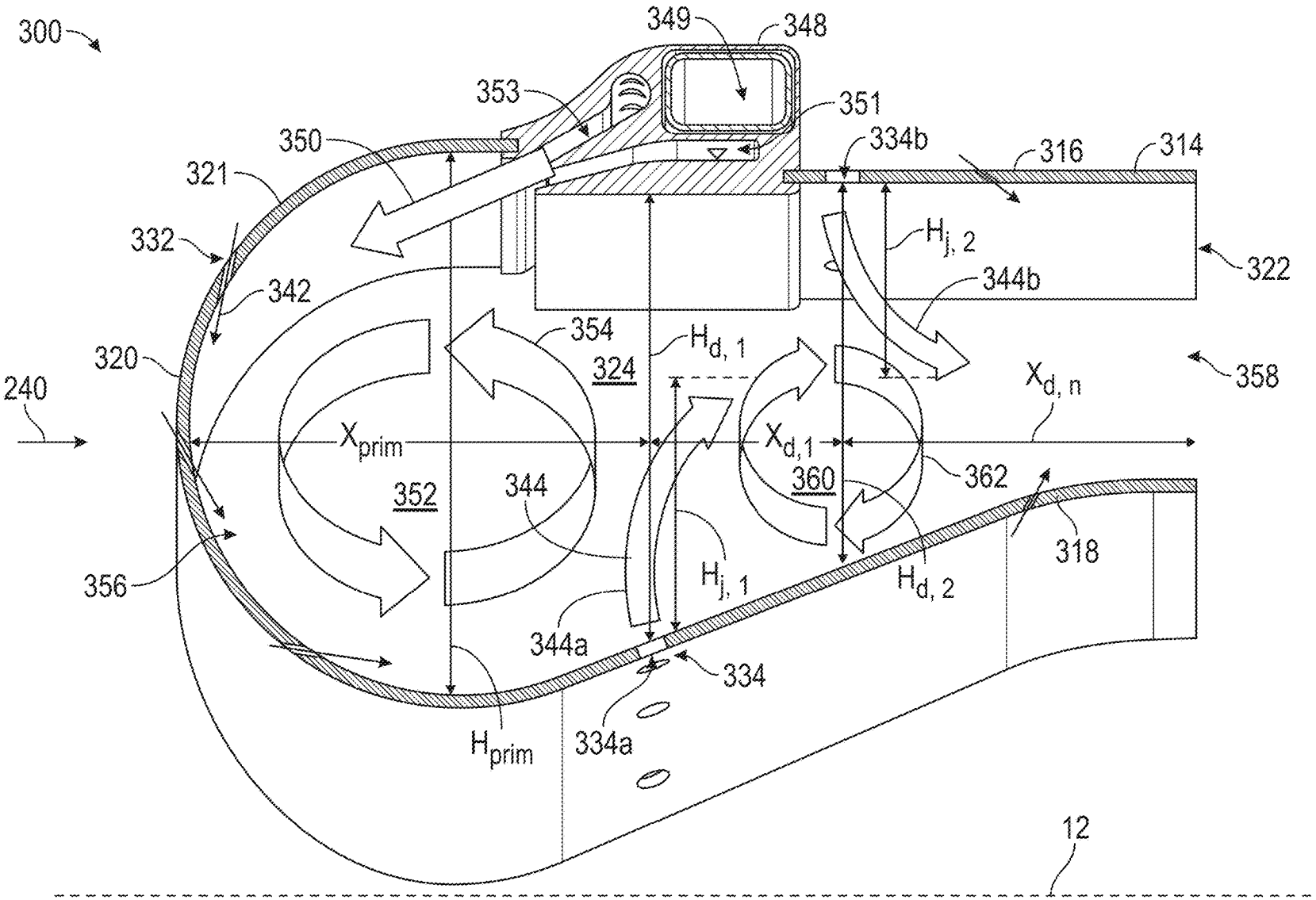
FIG. 3 illustrates a schematic, cross-sectional view of an annular vortex combustor for the turbine engine of FIG. 1, taken along a longitudinal centerline axis of the annular vortex combustor, according to the present disclosure.

FIG. 3 illustrates a schematic, cross-sectional view of an annular vortex combustor 300 taken along the longitudinal centerline axis 12. The annular vortex combustor 300 may be the same as or similar to the annular vortex combustor 200 (FIG. 2). Accordingly, like numbers represent like components. The difference between the annular vortex combustor 300 and the annular vortex combustor 200 will be described in more detail to follow. The remaining structure and function are the same as described with respect to the annular vortex combustor 200 of FIG. 2 and will not be described herein. Additionally, any of the alternatives to the annular vortex combustor 200 apply equally to the annular vortex combustor 300 of FIG. 3.

The annular vortex combustor 300 includes two vortices. The annular vortex combustor 300 has a combustor liner 314. The combustor liner 314 has an outer liner 316, an inner liner 318, a forward end 320, a dome 321, an aft end 322, a plurality of liner cooling holes 332 that provides a cooling flow 342, and a plurality of driver openings 334 that provides a driver flow 344. A combustion chamber 324 is formed within the combustor liner 314 and extends from an upstream end 356 to a downstream end 358. The annular vortex combustor 300 includes a fuel nozzle assembly 348 that includes a fuel manifold 349, a fuel injector 351, and an air injector 353. The fuel manifold 349 receives fuel from a fuel supply of the turbine engine 10 (FIG. 1) and the fuel injector 351 injects the fuel from the fuel manifold 349 into the combustion chamber 324 as a fuel flow 350. In some embodiments, the fuel nozzle assembly 348 is annular about the longitudinal centerline axis 12 (FIG. 1) and the fuel manifold 349 is annular about the fuel nozzle assembly 348. In such configurations, the fuel nozzle assembly 348 includes a plurality of fuel injectors 351 spaced circumferentially about the fuel nozzle assembly 348 and each in fluid communication with the fuel manifold 349. The air injector 353 directs a portion of the compressed air flow 240 (FIG. 2) therethrough and into the combustion chamber 324 such that the compressed air flow 240 mixes with the fuel flow 350 to generate the fuel-air mixture.

The combustion chamber 324 has a primary combustion zone 352 and a secondary combustion zone 360. The primary combustion zone 352 is defined between the forward end 320 and a first driver opening 334*a* of the plurality of driver openings 334. The secondary combustion zone 360 is defined downstream of the primary combustion zone 352. The secondary combustion zone 360 is defined between the first driver opening 334*a* and a second driver opening 334*b* of the plurality of driver openings 334. The second driver opening 334*b* is downstream of the first driver opening 334*a*. In FIG. 3, the first driver opening 334*a* extends through the inner liner 318 and the second driver opening 334*b* extends through the outer liner 316.

The fuel flow 350 and the compressed air flow 240 enter the annular vortex combustor 300 at the upstream end 356 and are ignited to combust within the primary combustion zone 352 of the combustion chamber 324 to generate a primary zone vortex 354. The location of the driver openings 334 allows for generation of a secondary zone vortex 362 within the combustion chamber 324. The secondary zone vortex 362 is an untrapped vortex, similar to the primary zone vortex 354. As illustrated in FIG. 3, the primary zone vortex 354 is located upstream of the first driver opening 334*a*. The secondary zone vortex 362 is located downstream of the first driver opening 334*a* and upstream of the second driver opening 334*b*. The secondary zone vortex 362 is downstream, and axially aft, of the primary zone vortex 354. In particular, the secondary zone vortex 362 is entirely downstream, and axially aft, of the primary zone vortex 354. The secondary zone vortex 362 has a lesser area than the primary zone vortex 354 due to the decreasing volume of the combustion chamber 324 from the upstream end 356 to the downstream end 358. The primary zone vortex 354 and the secondary zone vortex 362 are counterrotating. In particular, the primary zone vortex 354 rotates in the counterclockwise direction and the secondary zone vortex 362 rotates in the clockwise direction. In some examples, the rotation of the two vortices may be opposite to the directions illustrated in FIG. 3.

As with the annular vortex combustor 200, the sizing, the location, and the orientation (e.g., the angle at which the driver openings 334 are oriented) of the plurality of driver openings 334 is such that the air flow (e.g., a first driver flows 344*a* through the first driver opening 334*a* and the second driver flow 344*b* through the second driver opening 334*b*) reinforces the primary zone vortex 354 and the secondary zone vortex 362, and assists in keeping the primary zone vortex 354 and the secondary zone vortex 362 spinning or rotating. The first driver flow 344*a* entering the first driver opening 334*a* provides a curtain or a wall of air to assist the primary zone vortex 354, and the second driver flow 344*b* entering the second driver opening 334*b* provides a curtain or a wall of air to assist the secondary zone vortex 362.

With respect to the aspects shown in FIG. 3, multiple vortices increase residence time and mixing, reducing pattern and profile factor (e.g., combustor exit non-uniformity as measured by a non-dimensional temperature at the combustor exit, where profile is the average temperature and pattern is the maximum temperature) and emissions. Also, axially staggered driver openings (e.g., the inner driver flow and the outer driver flow) form the counter rotating vortices, and the driver openings may be angled tangentially to provide bulk swirl to the flow. Accordingly, considering the aspects shown in FIGS. 2 and 3, adding additional driver openings (n number of driver openings) may allow for additional vortices (n number of vortices) to be supported within the combustor. Thus, although two vortices are illustrated in FIG. 3, more may be provided by adding additional driver openings.

A size of the combustion chamber 324 is defined by the following dimensions. The primary combustion zone 352 has a maximum radial height $H_{prim}$ defined as a diameter of the combustion chamber 324 at the primary combustion zone 352 in the radial direction at an axial location where the diameter of the primary combustion zone 352 is greatest. In particular, the maximum radial height $H_{prim}$ is measured from an inner surface of the outer liner 316 to an inner surface of the inner liner 318. The combustion chamber 324 has a first driver hole radial height $H_{d,1}$ defined as a diameter of the combustion chamber 324 in the radial direction at an axial location of an axial center of the first driver opening 334*a*. In particular, the first driver hole radial height $H_{d,1}$ is measured from the inner surface of the outer liner 316 to the inner surface of the inner liner 318. The combustion chamber 324 has a second driver hole radial height $H_{d,2}$ defined as a diameter of the combustion chamber 324 in the radial direction at an axial location of an axial center of the second driver opening 334*b*. In particular, the second driver hole radial height $H_{d,2}$ is measured from the inner surface of the outer liner 316 to the inner surface of the inner liner 318. For an nth driver opening of the plurality of driver openings 334 (e.g., an nth number of driver openings), the nth driver opening has an nth driver hole radial height $H_{d,n}$ defined as a diameter of the combustion chamber 324 in the radial direction at an axial location of an axial center of the nth driver opening. In particular, the nth driver hole radial height $H_{d,n}$ is measured from the inner surface of the outer liner 316 to the inner surface of the inner liner 318.

The combustion chamber 324 has a primary zone axial distance $X_{prim}$ defined in the axial direction from the dome 321 to the first driver opening 334*a*. In particular, the primary zone axial distance $X_{prim}$ is measured from an inner surface of the dome 321 (e.g., a surface that faces the combustion chamber 324) at the upstream end 356 (e.g., the forward end 320) to the axial center of the first driver opening 334*a*. The combustion chamber 324 has a first driver opening axial distance $X_{d,1}$ defined in the axial direction from the first driver opening 334*a* to the second driver opening 334*b*. In particular, the first driver hole axial distance $X_{d,1}$ is measured from the axial center of the first driver opening 334*a* to the axial center of the second driver opening 334*b*. The combustion chamber 324 has an nth driver opening axial distance $X_{d,n}$ of an axially last driver opening defined in the axial direction from the nth driver opening to the downstream end 358 of the combustion chamber 324 (e.g., to a leading edge of the first stage nozzle 75 in FIG. 2). In particular, the nth driver hole axial distance $X_{d,n}$ is measured from the axial center of the nth driver opening to the combustion chamber exit (e.g., the leading edge of the first stage nozzle 75 (FIG. 2)) at the downstream end 358.

The driver openings 334 are sized and oriented to provide a penetration of the driver flow 344 into the combustion chamber 324. The penetration of the driver flow 344 is a radial extent of the driver flow 344 into the combustion chamber 324. The first driver flow 344*a* has a first driver flow penetration height $H_{j,1}$ defined as the radial height of the first driver flow 344*a* from the first driver opening 334*a*. In particular, the first driver flow penetration height $H_{j,1}$ is defined from an inner surface of the combustor liner 314 at the first driver opening 334*a* to a maximum radial extent of the first driver flow 344*a* within the combustion chamber 324. The second driver flow 344*b* has a second driver flow penetration height $H_{j,2}$ defined as the radial height of the second driver flow 344*b* from the second driver opening 334*b*. In particular, the second driver flow penetration height $H_{j,2}$ is defined from an inner surface of the combustor liner 314 at the second driver opening 334*b* to a maximum radial extent of the second driver flow 344*b* within the combustion chamber 324. An nth driver flow from the nth driver opening has an nth driver flow penetration height $H_{j,n}$ defined as the radial height of the nth driver flow from the nth driver opening. In particular, the nth driver flow penetration height $H_{j,n}$ is defined from an inner surface of the combustor liner 314 at the nth driver opening to a maximum radial extent of the nth driver flow within the combustion chamber 324.

The primary zone axial distance $X_{prim}$ is greater than or equal to half of the maximum radial height $H_{prim}$ and less than or equal to two point five times the maximum radial height $H_{prim}$ $((0.5*H_{prim})\leq X_{prim}\leq(2.5*H_{prim}))$. The first driver hole axial distance $X_{d,1}$ is greater than or equal to a quarter of the first driver opening radial height $H_{d,1}$ and less than or equal to two times the maximum radial height $H_{prim}$ $((0.25*H_{d,1})\leq X_{d,1}\leq(2.0*H_{prim}))$. The nth driver hole axial distance $X_{d,n}$ is greater than or equal to a quarter of the nth driver opening radial height $H_{d,n}$ $((0.25*H_{d,n})\leq X_{d,n})$.

The first driver flow penetration height $H_{j,1}$ is greater than or equal to half of the first driver opening radial height $H_{d,1}$ $((0.5*H_{d,1})\leq H_{j,1})$. The second driver flow penetration height $H_{j,2}$ is greater than or equal to half of the second driver opening radial height $H_{d,2}$ $((0.5*H_{d,2})\leq H_{j,2})$. The nth driver flow penetration height $H_{j,n}$ is greater than or equal to half of the nth driver opening radial height $H_{d,n}$ $((0.5*H_{d,n})\leq H_{j,n})$.

The liner cooling holes 332, the driver openings 334, and the air injector 353 are sized and oriented such that each of the liner cooling holes 332, the driver openings 334, and the air injector 353 provides a percentage of the compressed air flow 240 into the combustion chamber 324. In particular, the liner cooling holes 332 in the dome 321 are sized and oriented to provide five percent to twenty percent (5% to 20%) of the compressed air flow 240 into the combustion chamber 324. The liner cooling holes 332 in the outer liner 316 and the inner liner 318 (e.g., aft of the dome 321) are sized and oriented to provide five percent to twenty percent (5% to 20%) of the compressed air flow 240 into the combustion chamber 324. The driver openings 334 are sized and oriented to provide ten percent to fifty percent (10% to 50%) of the compressed air flow 240 into the combustion chamber 324. In particular, a sum of the driver flow 344 through each of the driver openings 334 is ten percent to fifty percent. The air injector 353 is sized and oriented to provide ten percent to fifty percent (10% to 50%) of the compressed air flow 240 into the combustion chamber 324.

Figure 4:
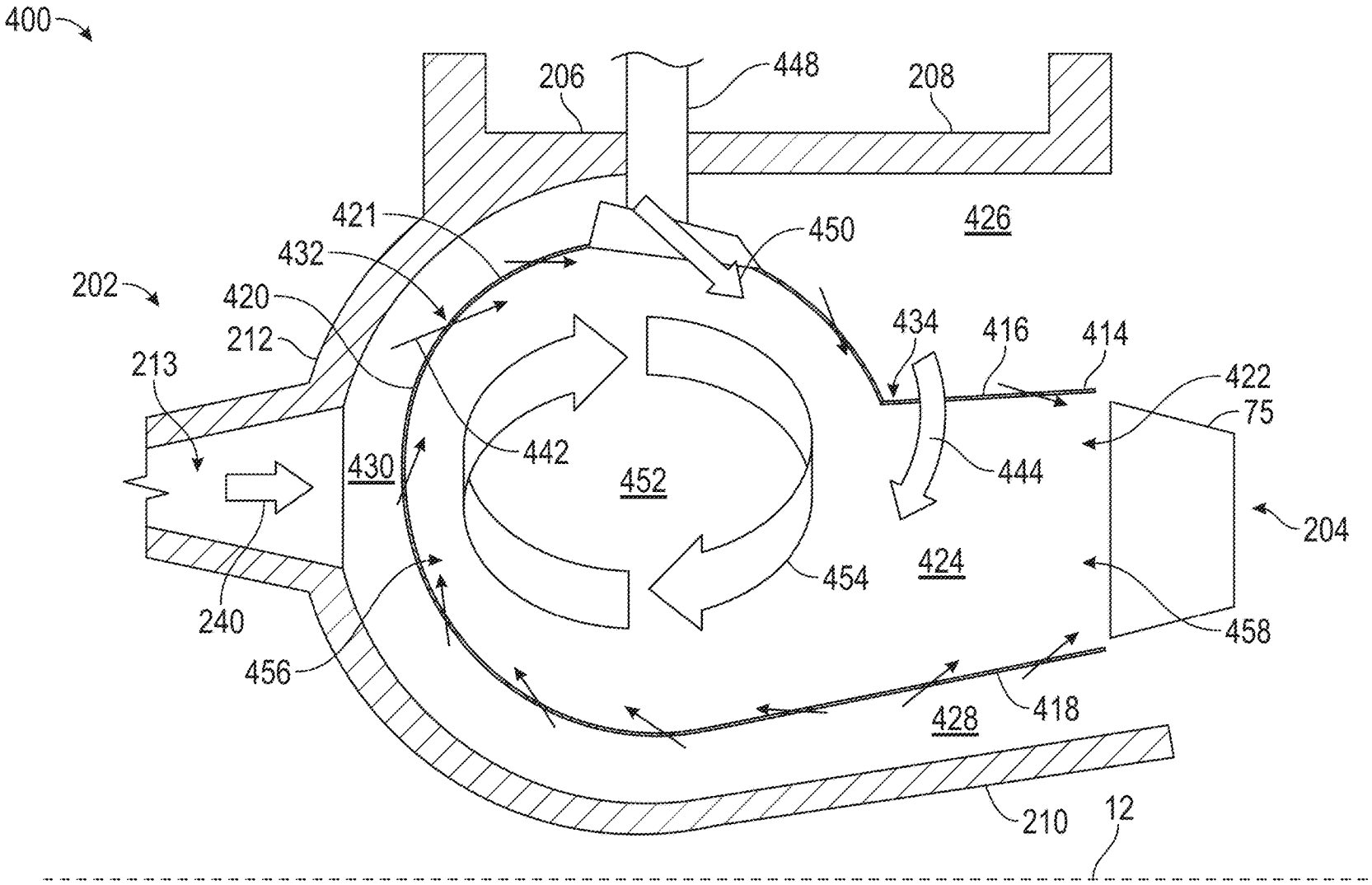
FIG. 4 illustrates a schematic, cross-sectional view of an annular vortex combustor for the turbine engine of FIG. 1, taken along a longitudinal centerline axis of the annular vortex combustor, according to the present disclosure.

FIG. 4 illustrates a schematic, cross-sectional view of an annular vortex combustor 400 taken along the longitudinal centerline axis 12. The annular vortex combustor 400 may be the same as or similar to the annular vortex combustor 200 (FIG. 2). Accordingly, like numbers represent like components. The difference between the annular vortex combustor 400 and the annular vortex combustor 200 will be described in more detail to follow. The remaining structure and function are the same as described with respect to the annular vortex combustor 200 of FIG. 2 and will not be described herein. Additionally, any of the alternatives to the annular vortex combustor 200 apply equally to the annular vortex combustor 400 of FIG. 4.

The annular vortex combustor 400 includes a single vortex, similar to the annular vortex combustor 200 of FIG. 2. The annular vortex combustor 400 has a combustor liner 414. The combustor liner 414 has an outer liner 416, an inner liner 418, a forward end 420, a dome 421, an aft end 422, a plurality of liner cooling holes 432 that provide a cooling flow 442, and one or more driver openings 434 that provides a driver flow 444. A combustion chamber 424 is formed within the combustor liner 414 and extends from an upstream end 456 to a downstream end 458. The outer casing 208 and the outer liner 416 form an outer passage 426 therebetween, the inner casing 210 and the inner liner 418 form an inner passage 428 therebetween, and a forward passage 430 connects the outer passage 426 and the inner passage 428, and is formed between the forward end 212 and the forward end 420. The annular vortex combustor 400 includes a fuel nozzle assembly 448 that provides a fuel flow 450.

The combustion chamber 424 has a primary combustion zone 452 defined between the forward end 420 and the one or more driver openings 434. In FIG. 4, the one or more driver openings 434 extend through the outer liner 416 aft of the fuel nozzle assembly 448.

The dome 421 is arc shaped having an arc that measures greater than one hundred eighty degrees (180°) and less than three hundred sixty degrees (360°). In this way, the dome 421 extends greater than a semi-circle and less than a circle. Such a configuration allows for the cooling flow 442 and the fuel flow 450 to flow in a generally same direction as the compressed air flow 240 (rather than in a direction opposite the compressed air flow 240, such as shown in FIG. 2). In particular, the liner cooling holes 432 are angled through the dome 421 to provide the cooling flow 442 tangentially and in the clockwise direction. The fuel nozzle assembly 448 is oriented to provide the fuel flow 450 in the downstream direction. In this way, a primary zone vortex 454 is formed in the primary combustion zone 452 that rotates in the clockwise direction. The shape of the dome 421 helps to drive and to maintain the primary zone vortex 454 within the primary combustion zone 452. Further, the volume of the combustion chamber 424 decreases from the primary combustion zone 452 towards the downstream end 458 due to the dome 421 being an arc that is greater than one hundred eighty degrees (180°). For example, an outer end of the dome 421 is radially closer to an inner end of the dome 421 as compared to the dome 221 of FIG. 2 due to the dome 421 being greater than a semi-circle. Such a configuration of the dome 421 provides an overall axial length of combustion chamber 424 to be less than the overall axial length of the combustion chamber 224 of FIG. 2.

Figure 5:
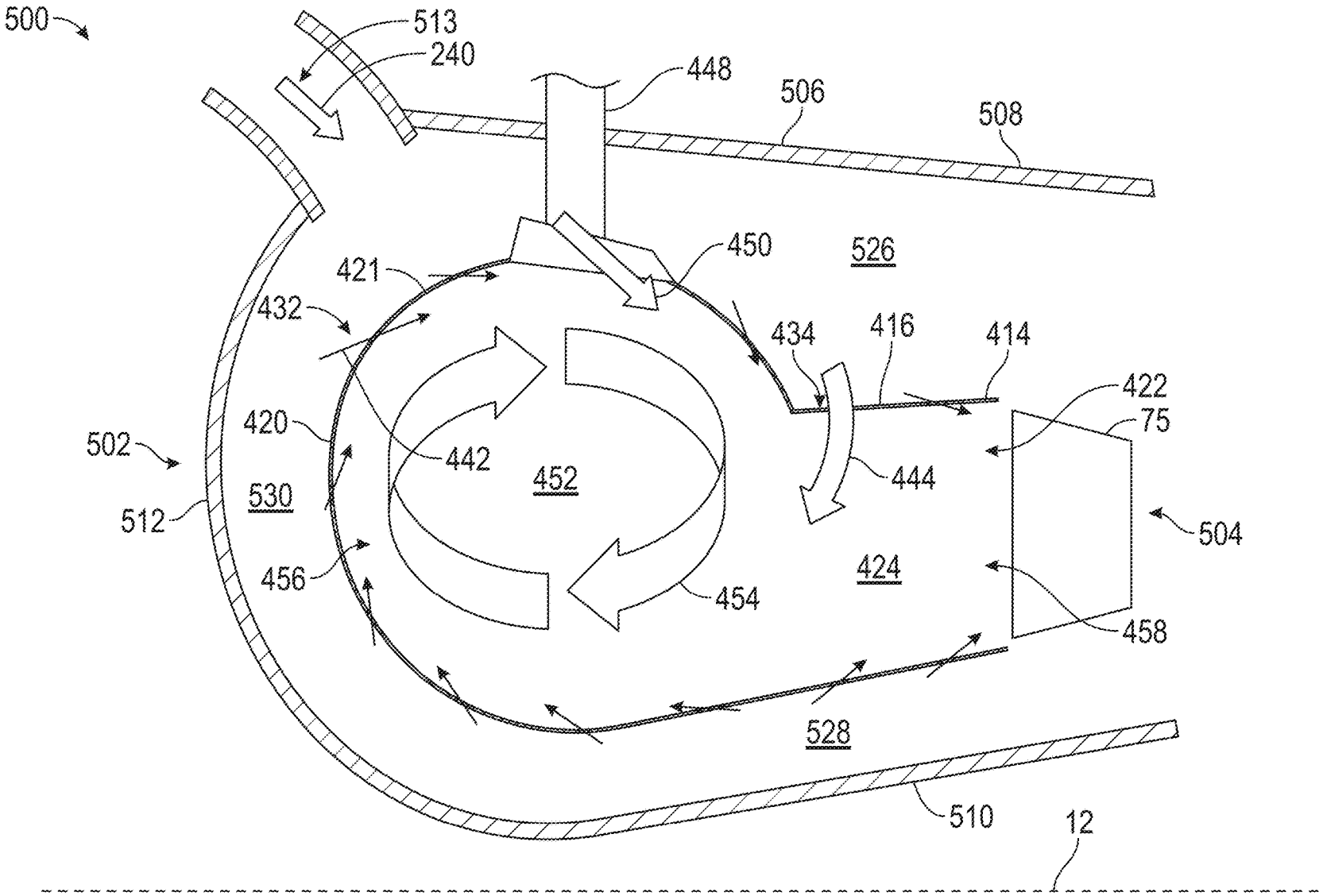
FIG. 5 illustrates a schematic, cross-sectional view of an annular vortex combustor for the turbine engine of FIG. 1, taken along a longitudinal centerline axis of the annular vortex combustor, according to the present disclosure.

FIG. 5 illustrates a schematic, cross-sectional view of an annular vortex combustor 500 taken along the longitudinal centerline axis 12. The annular vortex combustor 500 may be the same as or similar to the annular vortex combustor 400 (FIG. 4). Accordingly, like numbers represent like components. The difference between the annular vortex combustor 500 and the annular vortex combustor 400 will be described in more detail to follow. The remaining structure and function are the same as described with respect to the annular vortex combustor 400 of FIG. 4 and will not be described herein. Additionally, any of the alternatives to the annular vortex combustor 400 apply equally to the annular vortex combustor 500 of FIG. 5.

The annular vortex combustor 500 has a forward end 502, an aft end 504, and a combustor casing 506 that includes an outer casing 508, an inner casing 510, and a forward end 512. The outer casing 508 and the outer liner 416 form an outer passage 526 therebetween, the inner casing 510 and the inner liner 418 form an inner passage 528 therebetween, and a forward passage 530 connects the outer passage 526 and the inner passage 528 and is formed between the forward end 512 and the forward end 420. The annular vortex combustor 500 includes a diffuser inlet 513 that directs the compressed air flow 240 generally radially towards the combustion chamber 424. In particular, the diffuser inlet 513 is in fluid communication with the compressor section 22 (FIG. 1) and the compressor section 22 includes one or more centrifugal compressors that supply the compressed air flow 240 generally radially therethrough. The diffuser inlet 513 is oriented to de-swirl the compressed air flow 240 from the centrifugal compressors as the compressed air flow 240 passes through the diffuser inlet 513 into the annular vortex combustor 500.

Figure 6:
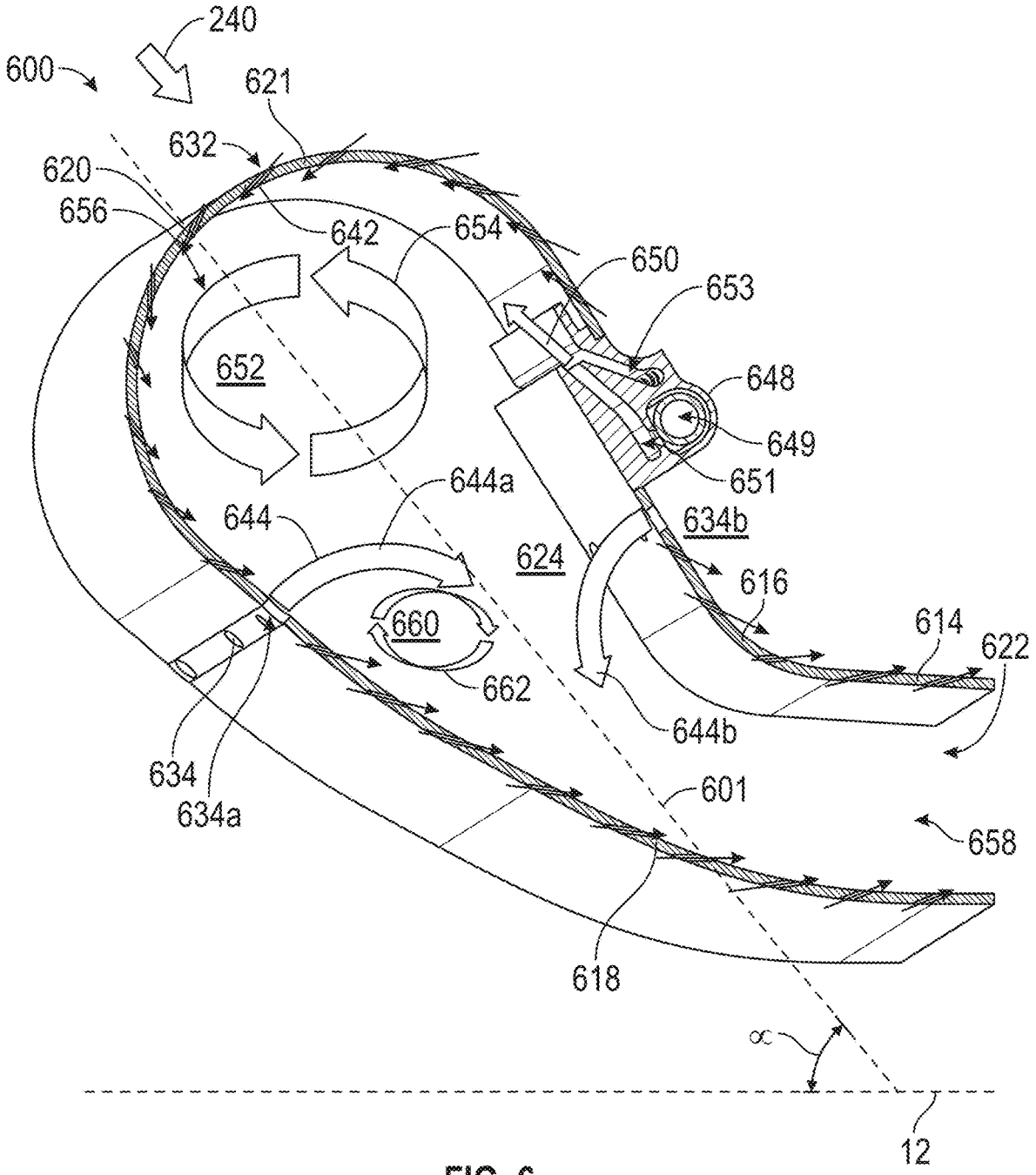
FIG. 6 illustrates a schematic, cross-sectional view of an annular vortex combustor for the turbine engine of FIG. 1, taken along a longitudinal centerline axis of the annular vortex combustor, according to the present disclosure.

FIG. 6 illustrates a schematic, cross-sectional view of an annular vortex combustor 600 taken along the longitudinal centerline axis 12. The annular vortex combustor 600 may be the same as or similar to the annular vortex combustor 300 of FIG. 3. Accordingly, like numbers represent like components. The difference between the annular vortex combustor 600 and the annular vortex combustor 300 will be described in more detail to follow. The remaining structure and function are the same as described with respect to the annular vortex combustor 300 of FIG. 3 and will not be described herein. Additionally, any of the alternatives to the annular vortex combustor 300 apply equally to the annular vortex combustor 600 of FIG. 6.

The annular vortex combustor 600 includes two vortices. The annular vortex combustor 600 has a combustor liner 614. The combustor liner 614 has an outer liner 616, an inner liner 618, a forward end 620, a dome 621, an aft end 622, a plurality of liner cooling holes 632 that provide a cooling flow 642, and a plurality of driver openings 634 that provides a driver flow 644. A combustion chamber 624 is formed within the combustor liner 614 and extends from an upstream end 656 to a downstream end 658. The annular vortex combustor 600 includes a fuel nozzle assembly 648 that includes a fuel manifold 649, a fuel injector 651, and an air injector 653.

The combustion chamber 624 has a primary combustion zone 652 and a secondary combustion zone 660. The primary combustion zone 652 is defined between the forward end 620 and a first driver opening 634*a* of the plurality of driver openings 634. The secondary combustion zone 660 is defined downstream of the primary combustion zone 652. The secondary combustion zone 660 is defined between the first driver opening 634*a* and a second driver opening 634*b* of the plurality of driver openings 634. The second driver opening 634*b* is downstream of the first driver opening 634*a*. In FIG. 6, the first driver opening 334*a* extends through the inner liner 618 and the second driver opening 634*b* extends through the outer liner 616.

The fuel flow 650 and the compressed air flow 240 enter the annular vortex combustor 600 at the upstream end 656 and are ignited to combust within the primary combustion zone 652 of the combustion chamber 624 to generate a primary zone vortex 654. The location of the driver openings 634 allows for generation of a secondary zone vortex 662 within the combustion chamber 624. As illustrated in FIG. 6, the primary zone vortex 654 is located upstream of the first driver opening 634*a*. The secondary zone vortex 662 is located downstream of the first driver opening 634*a* and upstream of the second driver opening 634*b*. The secondary zone vortex 662 is downstream, and axially aft, of the primary zone vortex 654.

As with the annular vortex combustor 200, the sizing, the location, and the orientation (e.g., the angle at which the driver openings 634 are oriented) of the one or more driver openings 634 is such that the air flow (e.g., a first driver flow 644*a* through the first driver opening 634*a* and a second driver flow 644*b* through the second driver opening 634*b*) reinforces the primary zone vortex 654 and the secondary zone vortex 662, and assists in keeping the primary zone vortex 654 and the secondary zone vortex 662 spinning or rotating.

The annular vortex combustor 600 includes a combustor longitudinal centerline axis 601 that extends orthogonally from the forward end 620 of the combustor liner 614. In FIG. 6, the annular vortex combustor 600 is angled at a cant angle $\alpha$ with respect to the longitudinal centerline axis 12. In particular, the combustor longitudinal centerline axis 601 is angled at the cant angle $\alpha$. The cant angle $\alpha$ is greater than zero degrees (0°) and less than or equal to ninety degrees (90°). In this way, the combustor longitudinal centerline axis 601 is not parallel with the longitudinal centerline axis 12. Such a configuration of the annular vortex combustor 600 provides for a high-G (e.g., high acceleration) swirl that is tangential to the first stage nozzle 75 (FIG. 2).

Figure 7:
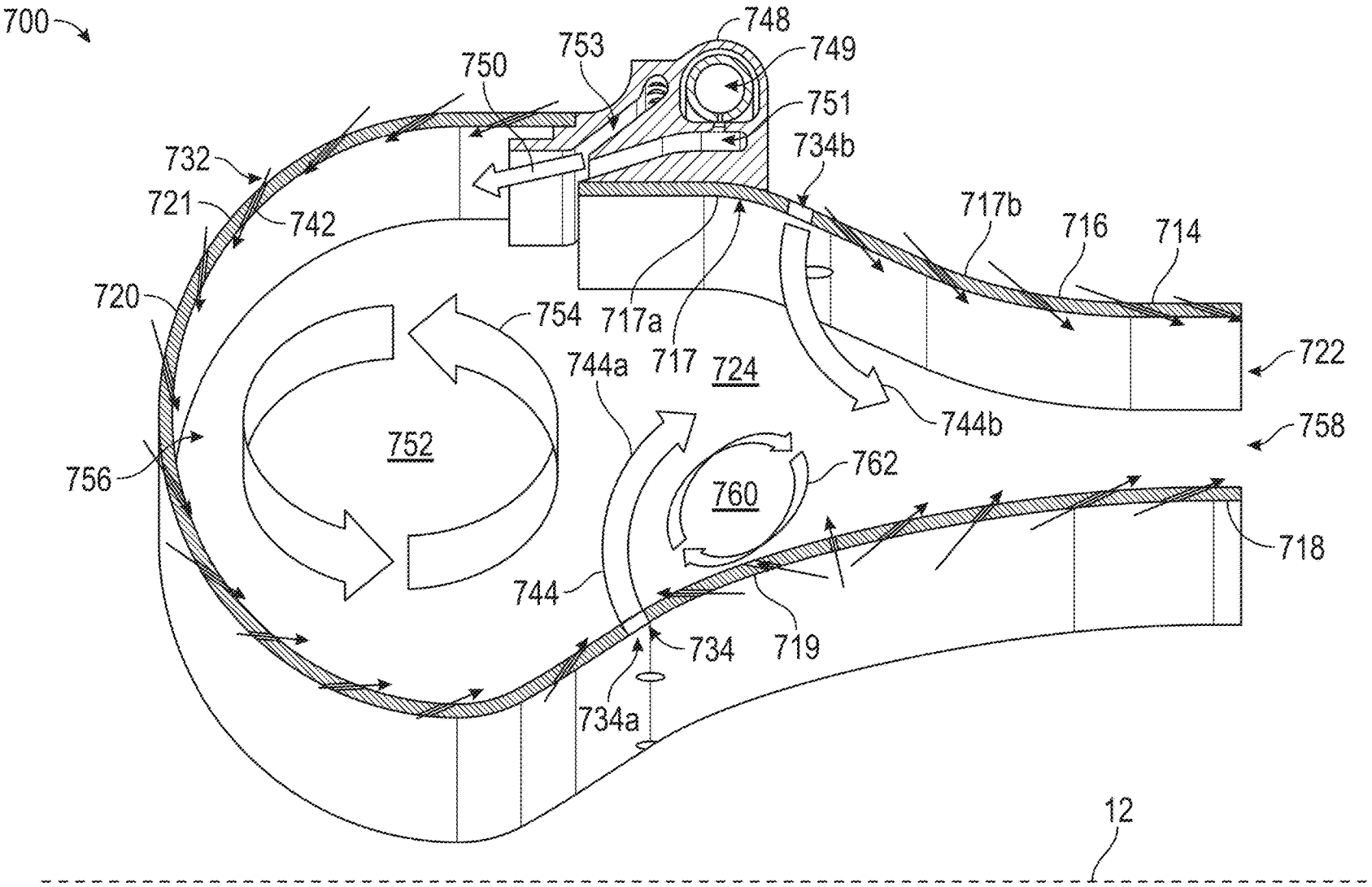
FIG. 7 illustrates a schematic, cross-sectional view of an annular vortex combustor for the turbine engine of FIG. 1, taken along a longitudinal centerline axis of the annular vortex combustor, according to the present disclosure.

FIG. 7 illustrates a schematic, cross-sectional view of an annular vortex combustor 700 taken along the longitudinal centerline axis 12. The annular vortex combustor 700 may be the same as or similar to the annular vortex combustor 300 (FIG. 3). Accordingly, like numbers represent like components. The difference between the annular vortex combustor 700 and the annular vortex combustor 300 will be described in more detail to follow. The remaining structure and function are the same as described with respect to the annular vortex combustor 300 of FIG. 3 and will not be described herein. Additionally, any of the alternatives to the annular vortex combustor 300 apply equally to the annular vortex combustor 700 of FIG. 7.

The annular vortex combustor 700 includes two vortices. The annular vortex combustor 700 has a combustor liner 714. The combustor liner 714 has an outer liner 716, an inner liner 718, a forward end 720, a dome 721, an aft end 722, a plurality of liner cooling holes 732 that provides a cooling flow 742, and a plurality of driver openings 734 that provides a driver flow 744. A combustion chamber 724 is formed within the combustor liner 714 and extends from an upstream end 756 to a downstream end 758. The annular vortex combustor 700 includes a fuel nozzle assembly 748 that includes a fuel manifold 749, a fuel injector 751 that provides a fuel flow 750, and an air injector 753.

The combustion chamber 724 has a primary combustion zone 752 with a primary zone vortex 754 and a secondary combustion zone 760 with a secondary zone vortex 762. The primary combustion zone 752 is defined between the forward end 720 and a first driver opening 734*a* of the plurality of driver openings 734. The secondary combustion zone 760 is defined downstream of the primary combustion zone 752. The secondary combustion zone 760 is defined between the first driver opening 734*a* (providing a first driver flow 744*a*) and a second driver opening 734*b* (providing a second driver flow 744*b*) of the plurality of driver openings 734. The liner cooling holes 732 that, in the inner liner 718, are positioned at the secondary combustion zone 760 include liner cooling holes 732 that angle the cooling flow 742 upstream towards the first driver flow 744*a* to help drive and to shape the secondary zone vortex 762. The liner cooling holes 732 downstream of the secondary combustion zone 760 are angled to direct the cooling flow 742 downstream towards the downstream end 758.

The combustor liner 714 is contoured downstream of the dome 721. In particular, the outer liner 716 has an outer liner contour that includes one or more outer liner curves 717 in the outer liner 716. In particular, the outer liner 716 includes a first outer liner curve 717*a* that curves the outer liner 716 towards the longitudinal centerline axis 12 from the dome 721 towards the downstream end 758. The first outer liner curve 717*a* defines a portion of the secondary combustion zone 760. The outer liner 716 includes a second outer liner curve 717*b* that curves the outer liner 716 away from the longitudinal centerline axis 12 downstream of the secondary combustion zone 760. In this way, the outer liner 716 becomes substantially axial (e.g., substantially parallel with the longitudinal centerline axis 12) downstream of the secondary combustion zone 760 towards the downstream end 758.

The inner liner 718 has an inner liner contour that includes one or more inner liner curves 719. In particular, the one or more inner liner curves 719 curve the inner liner 718 towards the longitudinal centerline axis 12 from the dome 721 towards the downstream end 758. The one or more inner liner curves 719 define a portion of the secondary combustion zone 760. In this way, the one or more inner liner curves 719 are generally axially aligned with the first outer liner curve 717*a*. The inner liner 718 becomes substantially axial downstream of the secondary combustion zone 760 towards the downstream end 758. Thus, the volume of the combustion chamber 724 decreases from the primary combustion zone 752 towards the downstream end 758. Such a configuration of the curves in the combustor liner 714 helps to shape and to maintain the primary zone vortex 754 and the secondary zone vortex 762.

Figure 8:
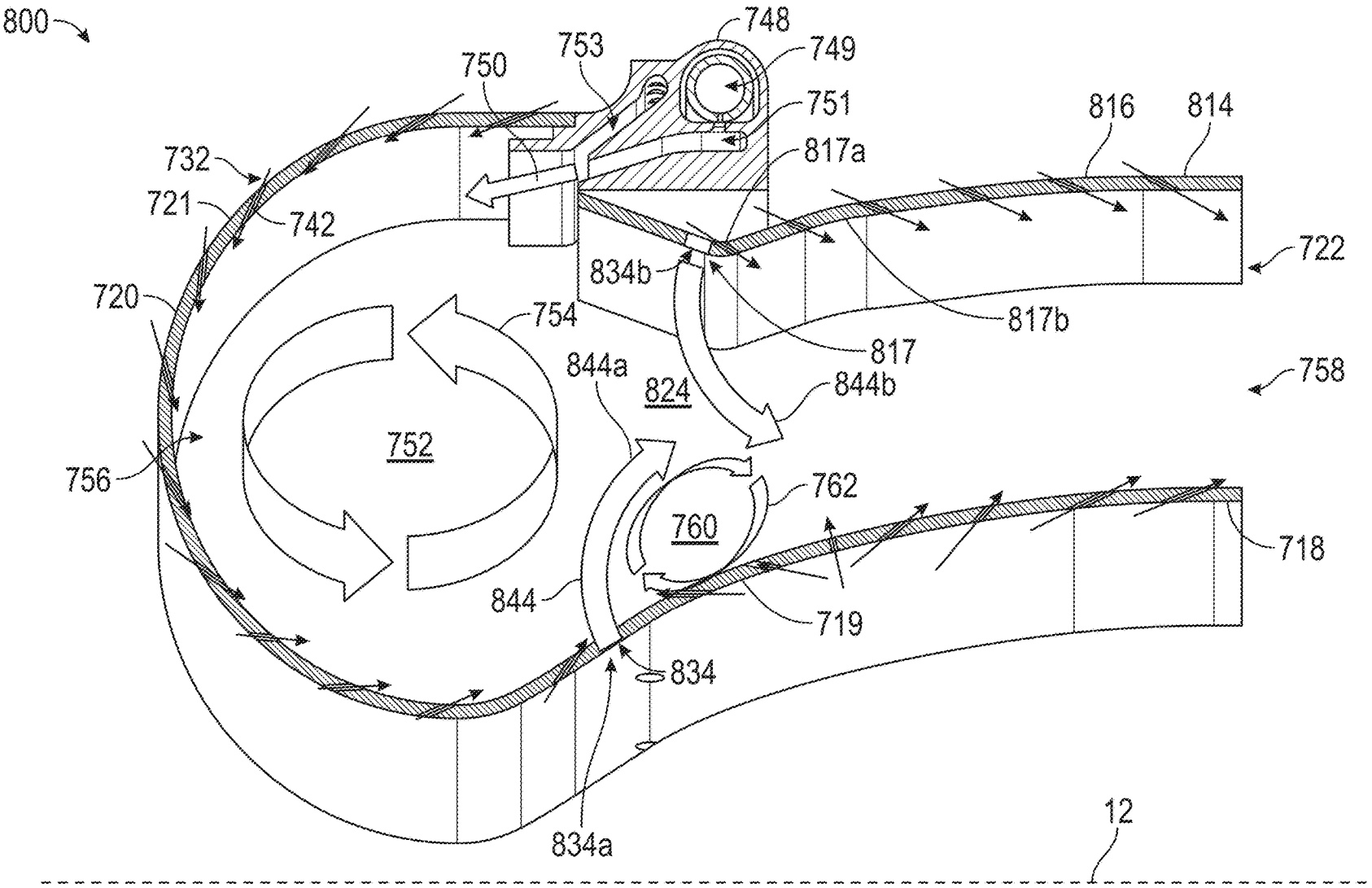
FIG. 8 illustrates a schematic, cross-sectional view of an annular vortex combustor for the turbine engine of FIG. 1, taken along a longitudinal centerline axis of the annular vortex combustor, according to the present disclosure.

FIG. 8 illustrates a schematic, cross-sectional view of an annular vortex combustor 800 taken along the longitudinal centerline axis 12. The annular vortex combustor 800 may be the same as or similar to the annular vortex combustor 300 (FIG. 3). Accordingly, like numbers represent like components. The difference between the annular vortex combustor 800 and the annular vortex combustor 300 will be described in more detail to follow. The remaining structure and function are the same as described with respect to the annular vortex combustor 300 of FIG. 3 and will not be described herein. Additionally, any of the alternatives to the annular vortex combustor 300 apply equally to the annular vortex combustor 800 of FIG. 8.

The annular vortex combustor 800 has a combustor liner 814. The combustor liner 814 has an outer liner 816, the inner liner 718, and a plurality of driver openings 834 that provides a driver flow 844. A combustion chamber 824 is formed within the combustor liner 814. The plurality of driver openings 834 includes a first driver opening 834*a* for providing a first driver flow 844*a* and a second driver opening 834*b* for providing a second driver flow 844*b*.

The combustor liner 814 is contoured downstream of the dome 721. In particular, the outer liner 816 has an outer liner contour that includes one or more outer liner curves 817. In particular, the outer liner 816 includes a first outer liner curve 817*a* that curves the outer liner 816 away from the longitudinal centerline axis 12 from the dome 721 towards the downstream end 758. The first outer liner curve 817*a* defines a portion of the secondary combustion zone 760. The outer liner 816 includes a second outer liner curve 817*b* that curves the outer liner 816 towards the longitudinal centerline axis 12 downstream of the secondary combustion zone 760. In this way, the outer liner 816 becomes substantially axial (e.g., substantially parallel with the longitudinal centerline axis 12) downstream of the secondary combustion zone 760 towards the downstream end 758. Such a configuration of the outer liner 816 helps to shape and to maintain the primary zone vortex 754 and the secondary zone vortex 762.

The second driver opening 834*b* is disposed through the first outer liner curve 817*a* such that the second driver opening 834*b* is orthogonal to the outer liner 816 and angled upstream with respect to the longitudinal centerline axis 12. The first driver flow 844*a* helps to angle the second drive flow 844*b* downstream within the combustion chamber 824.

Figure 9:
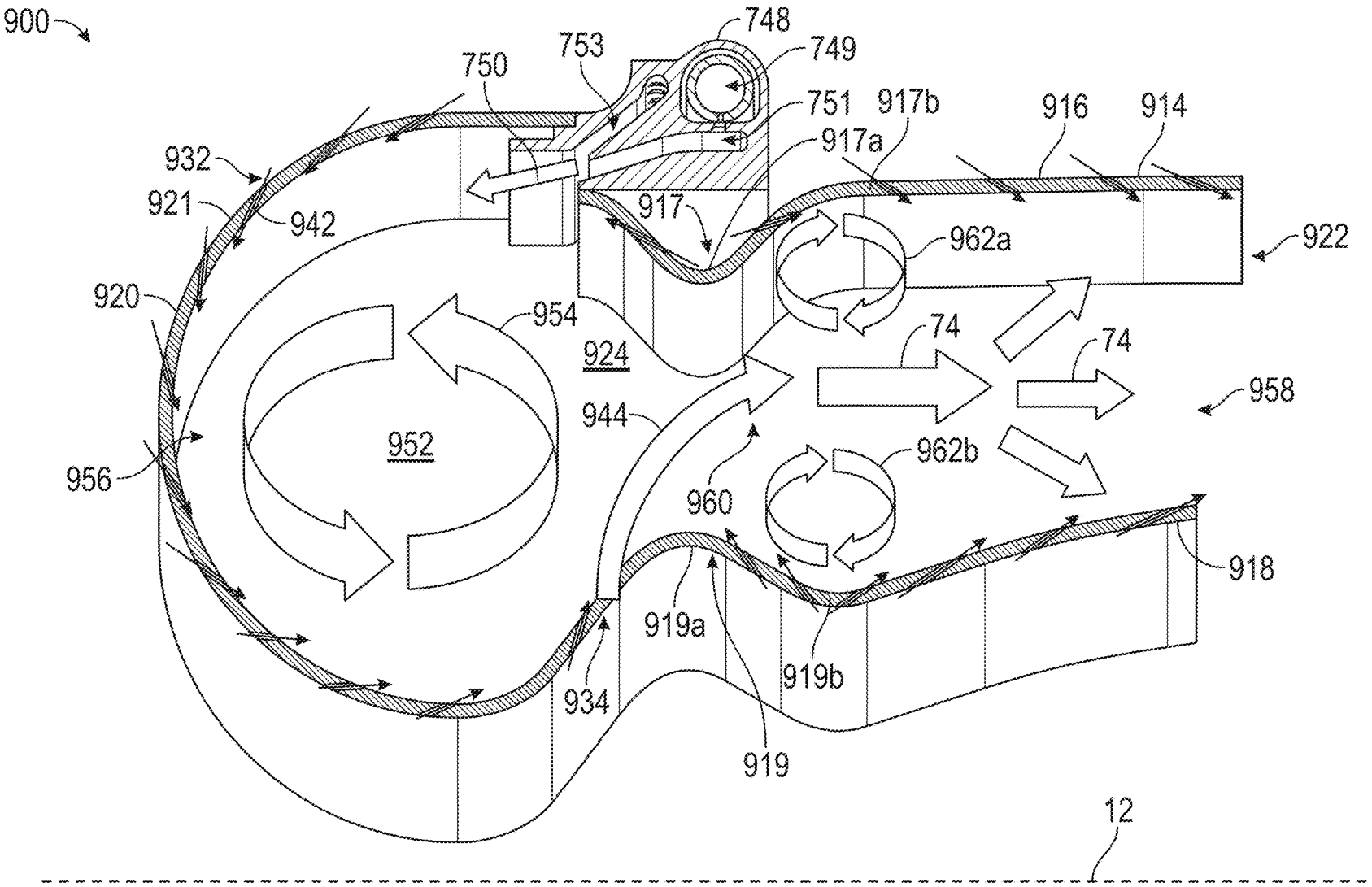
FIG. 9 illustrates a schematic, cross-sectional view of an annular vortex combustor for the turbine engine of FIG. 1, taken along a longitudinal centerline axis of the annular vortex combustor, according to the present disclosure.

FIG. 9 illustrates a schematic, cross-sectional view of an annular vortex combustor 900 taken along the longitudinal centerline axis 12. The annular vortex combustor 900 may be the same as or similar to the annular vortex combustor 300 (FIG. 3). Accordingly, like numbers represent like components. The difference between the annular vortex combustor 900 and the annular vortex combustor 300 will be described in more detail to follow. The remaining structure and function are the same as described with respect to the annular vortex combustor 300 of FIG. 3 and will not be described herein. Additionally, any of the alternatives to the annular vortex combustor 300 apply equally to the annular vortex combustor 900 of FIG. 9.

The annular vortex combustor 900 includes three vortices. The annular vortex combustor 900 has a combustor liner 914. The combustor liner 914 has an outer liner 916, an inner liner 918, a forward end 920, a dome 921, an aft end 922, a plurality of liner cooling holes 932 that provide a cooling flow 942, and one or more driver openings 934 that provides a driver flow 944. A combustion chamber 924 is formed within the combustor liner 914 and extends from an upstream end 956 to a downstream end 958. The annular vortex combustor 900 includes the fuel nozzle assembly 748.

The combustion chamber 924 has a primary combustion zone 952 with a primary zone vortex 954 and a secondary combustion zone 960 with a first secondary zone vortex 962*a*, and a second secondary zone vortex 962*b*. The primary combustion zone 952 is defined between the forward end 920 and the one or more driver openings 934. The one or more driver openings 934 are spaced circumferentially at a single axial location. The secondary combustion zone 960 is defined downstream of the primary combustion zone 952. In particular, the secondary combustion zone 960 is defined by a curvature of the inner liner 918 and the outer liner 916. The combustor liner 914 is contoured downstream of the dome 921 to define the secondary combustion zone 960.

The outer liner 916 has an outer liner contour that includes one or more outer liner curves 917. In particular, the outer liner 916 includes a first outer liner curve 917*a* that curves the outer liner 916 away from the longitudinal centerline axis 12 from the dome 921 towards the downstream end 958.

The outer liner 916 includes a second outer liner curve 917*b* that curves the outer liner 916 towards the longitudinal centerline axis 12 from the first outer liner curve 917*a*. In this way, the outer liner 916 becomes substantially axial (e.g., substantially parallel with the longitudinal centerline axis 12) downstream of the secondary combustion zone 960 towards the downstream end 958. The second outer liner curve 917*b* defines a portion of the secondary combustion zone 960. In particular, the secondary combustion zone 960 is axially downstream of the first outer liner curve 917*a* and axially aligned with the second outer liner curve 917*b*, such that the first secondary zone vortex 962*a* is nested within the second outer liner curve 917*b*. The liner cooling holes 932 at the first outer liner curve 917*a* and the second outer liner curve 917*b* help to shape and to maintain the first secondary zone vortex 962*a*.

The first outer liner curve 917*a* has a large curvature with a small radius such that the first outer liner curve 917*a* is a sharp bend. In this way, the first outer liner curve 917*a* extends further into the combustion chamber 924 as compared to the first outer liner curve 717*a* of FIG. 7. The second outer liner curve 917*b* has a small curvature with a large radius such that the second outer liner curve 917*b* has a gradual bend, as compared to the first outer liner curve 917*a*.

The inner liner 918 has an inner liner contour that includes one or more inner liner curves 919. In particular, the inner liner 918 includes a first inner liner curve 919*a* that curves the inner liner 918 towards the longitudinal centerline axis 12 from the dome 921 towards the downstream end 958.

The inner liner 918 includes a second inner liner curve 919*b* that curves the inner liner 918 away from the longitudinal centerline axis 12 from the first inner liner curve 919*a*. In this way, the inner liner 918 becomes substantially axial (e.g., substantially parallel with the longitudinal centerline axis 12) downstream of the secondary combustion zone 960 towards the downstream end 958. The second inner liner curve 919*b* defines a portion of the secondary combustion zone 960. In particular, the secondary combustion zone 960 is axially downstream of the first inner liner curve 919*a* and axially aligned with the second inner liner curve 919*b*, such that the second secondary zone vortex 962*b* is nested within the second inner liner curve 919*b*. The liner cooling holes 932 at the first inner liner curve 919*a* and the second inner liner curve 919*b* help to shape and to maintain the second secondary zone vortex 962*b*.

The first secondary zone vortex 962*a* and the second secondary zone vortex 962*b* are axially aligned and radially spaced from each other. The first secondary zone vortex 962*a* and the second secondary zone vortex 962*b* are formed by the cooling flow 942 with the Coanda effect (e.g., a tendency of a fluid jet to stay attached to a surface). In particular, the liner cooling holes 932 at the second outer liner curve 917*b* and the second inner liner curve 919*b* are angled to direct the cooling flow 942 along the outer liner 916 and the inner liner 918, respectively, such that the cooling flow 942 stays attached to the outer liner 916 and the inner liner 918 to help shape and to maintain the first secondary zone vortex 962*a* and the second secondary zone vortex 962*b*.

The first inner liner curve 919*a* has a large curvature with a small radius such that the first inner liner curve 919*a* has a sharp bend. In this way, the first inner liner curve 919*a* extends further into the combustion chamber 924, as compared to the inner liner curves 719 of FIG. 7. The second inner liner curve 919*b* has a small curvature with a large radius, such that the second inner liner curve 919*b* has a gradual bend as compared to the first inner liner curve 919*a*.

Such a configuration of the outer liner curves 917 and the inner liner curves 919 provides for a converging/diverging combustor liner 914. In particular, the combustor liner 914 converges from the dome 921 to the first outer liner curve 917*a* and the first inner liner curve 919*a*. The combustor liner 914 then diverges from the first outer liner curve 917*a* and the first inner liner curve 919*a* due to the second outer liner curve 917*b* and the second inner liner curve 919*b*, respectively. In this way, the combustion chamber 924 is a converging/diverging combustion chamber. The first outer liner curve 917*a* and the first inner liner curve 919*a* define a throat (e.g., a smallest volume) of the combustion chamber 924.

Figure 10:
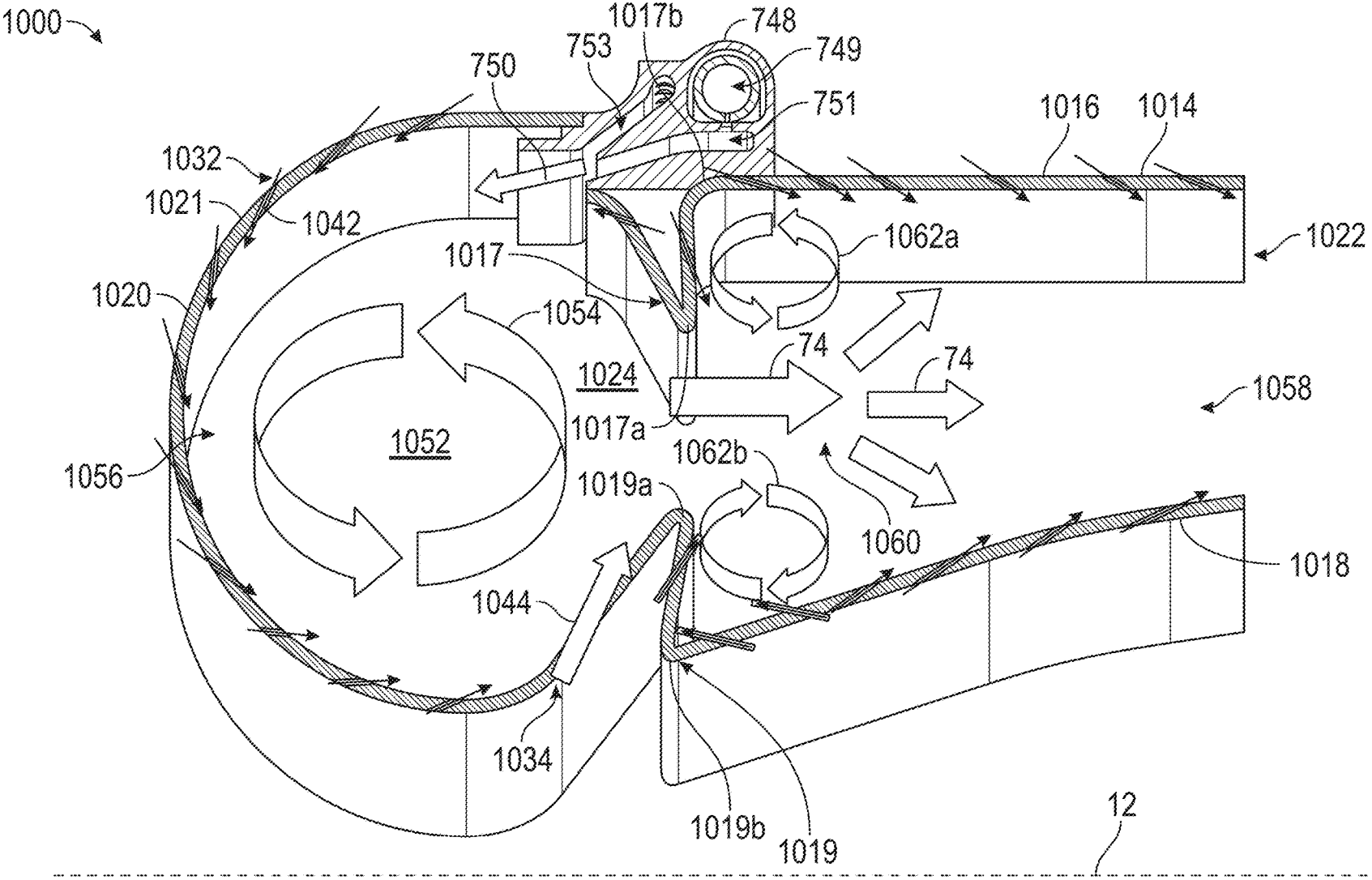
FIG. 10 illustrates a schematic, cross-sectional view of an annular vortex combustor for the turbine engine of FIG. 1, taken along a longitudinal centerline axis of the annular vortex combustor, according to the present disclosure.

FIG. 10 illustrates a schematic, cross-sectional view of an annular vortex combustor 1000 taken along the longitudinal centerline axis 12. The annular vortex combustor 1000 may be the same as or similar to the annular vortex combustor 900 (FIG. 9). Accordingly, like numbers represent like components. The difference between the annular vortex combustor 1000 and the annular vortex combustor 900 will be described in more detail to follow. The remaining structure and function are the same as described with respect to the annular vortex combustor 900 of FIG. 9 and will not be described herein. Additionally, any of the alternatives to the annular vortex combustor 900 apply equally to the annular vortex combustor 1000 of FIG. 10.

The annular vortex combustor 1000 includes three vortices. The annular vortex combustor 1000 has a combustor liner 1014. The combustor liner 1014 has an outer liner 1016, an inner liner 1018, a forward end 1020, a dome 1021, an aft end 1022, a plurality of liner cooling holes 1032 that provides a cooling flow 1042, and one or more driver openings 1034 that provide a driver flow 1044. A combustion chamber 1024 is formed within the combustor liner 1014 and extends from an upstream end 1056 to a downstream end 1058. The annular vortex combustor 1000 includes the fuel nozzle assembly 748.

The combustion chamber 1024 has a primary combustion zone 1052 with a primary zone vortex 1054 and a secondary combustion zone 1060 with a first secondary zone vortex 1062*a* and a second secondary zone vortex 1062*b*. The secondary combustion zone 1060 is defined downstream of the primary combustion zone 1052. In particular, the secondary combustion zone 1060 is defined by a curvature of the inner liner 1018 and the outer liner 1016. The combustor liner 1014 is contoured downstream of the dome 1021 to define the secondary combustion zone 1060.

The outer liner 1016 has an outer liner contour that includes one or more outer liner curves 1017 in the outer liner 1016. In particular, the outer liner 1016 includes a first outer liner curve 1017*a* that curves the outer liner 1016 away from the longitudinal centerline axis 12 from the dome 1021 towards the downstream end 1058.

The outer liner 1016 includes a second outer liner curve 1017*b* that curves the outer liner 1016 towards the longitudinal centerline axis 12 from the first outer liner curve 1017*a*. In this way, the outer liner 1016 becomes substantially axial (e.g., substantially parallel with the longitudinal centerline axis 12) downstream of the secondary combustion zone 1060 towards the downstream end 1058. The second outer liner curve 1017*b* defines a portion of the secondary combustion zone 1060. In particular, the secondary combustion zone 1060 is axially downstream of the first outer liner curve 1017*a* and axially aligned with the second outer liner curve 1017*b* such that the first secondary zone vortex 1062*a* is nested within the second outer liner curve 1017*b*. The liner cooling holes 1032 at the first outer liner curve 1017*a* and the second outer liner curve 1017*b* help to shape and to maintain the first secondary zone vortex 1062*a*.

The first outer liner curve 1017*a* has a large curvature with a small radius such that the first outer liner curve 1017*a* is a sharp bend. In particular, the first outer liner curve 1017*a* defines a hairpin bend such that an inner angle of the first outer liner curve 1017*a* is an acute angle. In this way, the first outer liner curve 1017*a* extends further into the combustion chamber 1024 as compared to the first outer liner curve 917*a* of FIG. 9. The second outer liner curve 1017*b* has a large curvature with a small radius such that the second outer liner curve 1017*b* is a sharp bend. In this way, the outer liner 1016 defines a step between the first outer liner curve 1017*a* and the second outer liner curve 1017*b* that is substantially radial (e.g., substantially parallel with the radial direction).

The inner liner 1018 has an inner liner contour that includes one or more inner liner curves 1019. In particular, the inner liner 1018 includes a first inner liner curve 1019*a* that curves the inner liner 1018 towards the longitudinal centerline axis 12 from the dome 1021 towards the downstream end 1058.

The inner liner 1018 includes a second inner liner curve 1019*b* that curves the inner liner 1018 away from the longitudinal centerline axis 12 from the first inner liner curve 1019*a*. In this way, a radius of the inner liner 1018 gradually increases as the inner liner 1018 extends axially downstream of the secondary combustion zone 1060 towards the downstream end 1058. The second inner liner curve 1019*b* defines a portion of the secondary combustion zone 1060. In particular, the secondary combustion zone 1060 is axially downstream of the first inner liner curve 1019*a* and axially aligned with the second inner liner curve 1019*b* such that the second secondary zone vortex 1062*b* is nested within the second inner liner curve 1019*b*. The liner cooling holes 1032 at the first inner liner curve 1019*a* and the second inner liner curve 1019*b* help to shape and to maintain the second secondary zone vortex 1062*b*.

The first inner liner curve 1019*a* has a large curvature with a small radius such that the first inner liner curve 1019*a* is a sharp bend. In particular, the first inner liner curve 1019*a* defines a hairpin bend such that an inner angle of the first inner liner curve 1019*a* is an acute angle. In this way, the first inner liner curve 1019*a* extends further into the combustion chamber 1024 as compared to the first inner liner curve 919*a* of FIG. 9. The second inner liner curve 1019*b* has a large curvature with a small radius such that the second inner liner curve 1019*b* is a sharp bend. In this way, the inner liner 1018 defines a step between the first inner liner curve 1019*a* and the second inner liner curve 1019*b* that is angled greater than zero degrees and less than ninety degrees with respect to the longitudinal centerline axis 12.

Such a configuration of the outer liner curves 1017 and the inner liner curves 1019 provides for a convergent step combustor liner 1014. In particular, the combustor liner 1014 converges from the dome 1021 to the first outer liner curve 1017*a* and the first inner liner curve 1019*a*. The combustor liner 1014 then has a step from the first outer liner curve 1017*a* and the first inner liner curve 1019*a*, as detailed above. In this way, the combustion chamber 1024 has a more severe contraction at the throat as compared to the combustion chamber 924. Such a configuration of the combustion chamber 1024 provides for flow separation on an aft side of the throat to encourage smaller vortices. In particular, the first secondary zone vortex 1062*a* and the second secondary zone vortex 1062*b* have a lesser diameter than the first secondary zone vortex 962*a* and the second secondary zone vortex 962*b* of FIG. 9.

Figure 11:
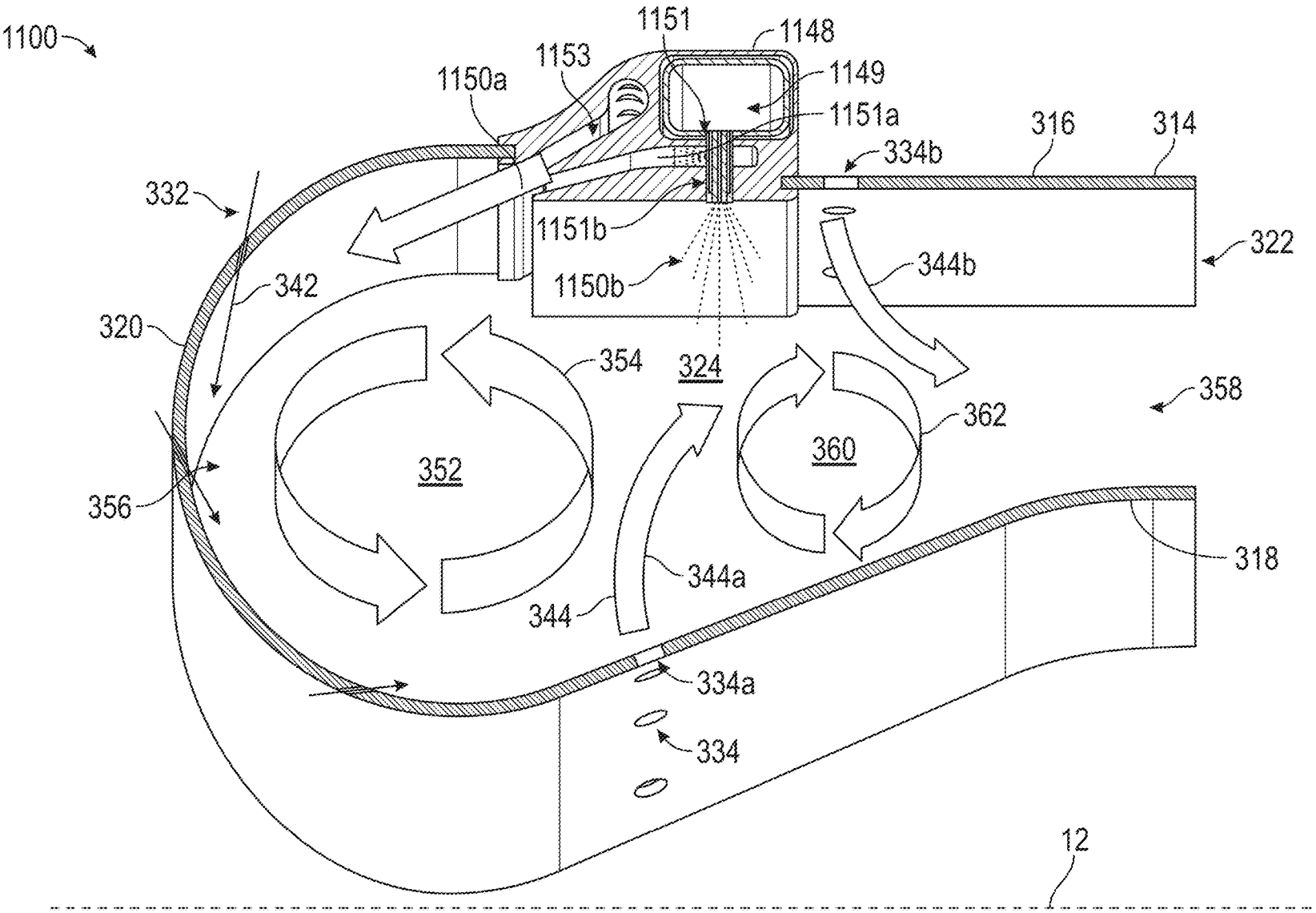
FIG. 11 illustrates a schematic, cross-sectional view of an annular vortex combustor for the turbine engine of FIG. 1, taken along a longitudinal centerline axis of the annular vortex combustor, according to the present disclosure.

FIG. 11 illustrates a schematic, cross-sectional view of an annular vortex combustor 1100 taken along the longitudinal centerline axis 12. The annular vortex combustor 1100 may be the same as or similar to the annular vortex combustor 300 (FIG. 3). Accordingly, like numbers represent like components. The difference between the annular vortex combustor 1100 and the annular vortex combustor 300 will be described in more detail to follow. The remaining structure and function are the same as described with respect to the annular vortex combustor 300 of FIG. 3 and will not be described herein. Additionally, any of the alternatives to the annular vortex combustor 300 apply equally to the annular vortex combustor 1100 of FIG. 11.

The annular vortex combustor 1100 includes a fuel nozzle assembly 1148 that is different from the fuel nozzle assembly 348 of FIG. 3. The fuel nozzle assembly 1148 includes a fuel manifold 1149, a plurality of fuel injectors 1151, and an air injector 1153. The plurality of fuel injectors 1151 includes a first fuel injector 1151*a* and a second fuel injector 1151*b*. The first fuel injector 1151*a* injects the fuel tangentially and towards the upstream end 356 as a first fuel flow 1150*a*. In this way, the first fuel flow 1150*a* feeds the primary zone vortex 354. The second fuel injector 1151*b* injects the fuel directly into the combustion gases from the primary combustion zone 352 downstream of the primary combustion zone 352. In particular, the second fuel injector 1151*b* injects the fuel radially into the combustion chamber 324 as a second fuel flow 1150*b*. The second fuel flow 1150*b* feeds the primary zone vortex 354 and the secondary zone vortex 362. In some embodiments, the second fuel injector 1151*b* can be angled towards the upstream end 356 to provide a greater amount of fuel to the primary zone vortex 354. In some embodiments, the second fuel injector 1151*b* can be angled towards the downstream end 358 to provide a greater amount of fuel to the secondary zone vortex 362.

Such a configuration of the plurality of fuel injectors 1151 can extend the auto-ignition delay time allowing for the second fuel flow 1150*b* to mix longer before igniting and burning. In this way, the second fuel flow 1150*b* reduces local hot streaks potentially further reducing pattern factor, NOx, and smoke from the secondary combustion zone 360. In particular, the longer the fuel and the air is mixed, the more uniform the mixture will become, thus, providing for a more uniform combustor exit temperature. The split of the second fuel flow 1150*b* between the primary zone vortex 354 and the secondary zone vortex 362 can be used to control a radial shaping of a thermal profile of the combustion chamber 324 at an exit of the combustion chamber 324 (e.g., at the downstream end 358).

Figure 12:
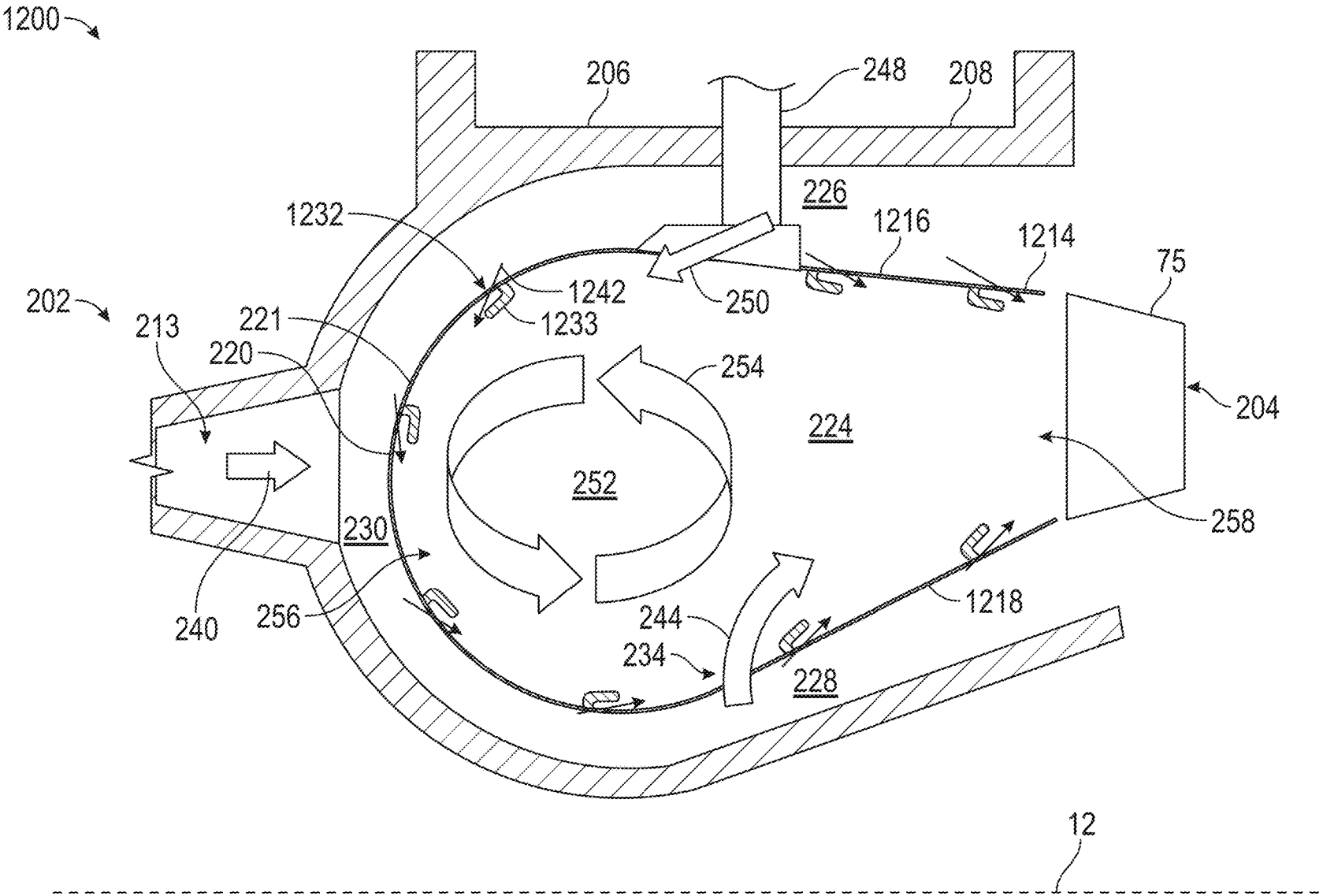
FIG. 12 illustrates a schematic, cross-sectional view of an annular vortex combustor for the turbine engine of FIG. 1, taken along a longitudinal centerline axis of the annular vortex combustor, according to the present disclosure.

FIG. 12 illustrates a schematic, cross-sectional view of an annular vortex combustor 1200 taken along the longitudinal centerline axis 12. The annular vortex combustor 1200 may be the same as or similar to the annular vortex combustor 200 (FIG. 2). Accordingly, like numbers represent like components. The difference between the annular vortex combustor 1200 and the annular vortex combustor 200 will be described in more detail to follow. The remaining structure and function are the same as described with respect to the annular vortex combustor 200 of FIG. 2 and will not be described herein. Additionally, any of the alternatives to the annular vortex combustor 200 apply equally to the annular vortex combustor 1200 of FIG. 12.

The annular vortex combustor 1200 has a combustor liner 1214 that includes an outer liner 1216, an inner liner 1218, and a plurality of liner cooling holes 1232 that provide a cooling flow 1242. The annular vortex combustor 1200 also includes a plurality of slots, also referred to as a plurality of nuggets 1233. Each respective one of the nuggets 1233 is aligned at a respective row of the plurality of liner cooling holes 1232. In particular, each respective one of the nuggets 1233 is annular about the combustion chamber 224. The plurality of nuggets 1233 helps to direct the cooling flow 1242 from the plurality of liner cooling holes 1232 into the combustion chamber 224. In particular, the plurality of nuggets 1233 directs the cooling flow 1242 to provide film cooling along the combustor liner 1214 and help to shape and to maintain the primary zone vortex 254 along the dome 221.

Accordingly, the annular vortex combustors 200 to 1200 having the vortices therein increase residence time and mixing of the fuel and the air in the combustion process, which reduces pattern factor and emissions, as compared to combustors without the benefit of the present disclosure. Such a configuration of the annular vortex combustors 200 to 1200 allows the annular vortex combustors 200 to 1200 to have a lesser axial length as compared to combustors without the benefit of the present disclosure.

The driver openings of the present disclosure may be perpendicular to the longitudinal centerline axis 12 or may be angled (radially, circumferentially, or both) with respect to the longitudinal centerline axis 12 at an angle greater than zero degrees and less than ninety degrees. In some examples, the angle may be tangential to an inner surface of the combustor liner. Each driver opening of the one or more driver openings is larger than each cooling hole of the plurality of cooling holes.

As illustrated, the driver openings of each of the annular vortex combustors 200 to 1200 described herein are oriented in a radial direction. In some examples, the driver openings are also angled in the axial direction (e.g., angled left and right on the page with respect to the longitudinal centerline axis 12). In some embodiments, the driver openings are also angled in the circumferential direction (e.g., angled into and out of the page with respect to the longitudinal centerline axis 12). In some examples, the driver openings are also both axially and circumferentially angled. In some examples, the driver openings are angled such that the openings are tangential with an internal surface of the combustor liner.

Accordingly, the annular vortex combustors 200 to 1200 of the present disclosure allow for increased residence time, while also allowing for decreased combustor length, as compared to combustors without untrapped vortices and without the liner contours discussed herein. In particular, the decreasing volume of the combustion chamber allows for a larger vortex and recirculation zone for mixing and residence time, while transitioning to a size of the turbine inlet for a smooth flow into the HP turbine. The narrowing of the combustion chamber also helps reinforce the vortex in the primary zone, while also reducing the length of the combustion chamber. The driver openings present in the combustors of the present disclosure assist in shaping the vortex. The increased residence time and the shaping of the vortex increase mixing of the fuel and the air.

The annular vortex combustors of the present disclose provide (1) a vortex that is fed (e.g., air fed) in the direction of the inlet air flow, (2) no turning losses when feeding the fuel block (e.g., the fuel nozzle assembly), (3) the dome contour helps to shape and to maintain the primary zone vortex, (4) the second and the third vortices (e.g., FIGS. 3 and 6 to 11) increase residence time and mixing, (5) the driver openings are positioned to shape vortices and to form flow temperature profile factors and pattern factors, (6) the tangentially oriented driver openings induce a bulk swirl to provide a turning benefit for the stage one turbine nozzle, or (7) any combination of the aforementioned advantages.

With respect to (1) and (2) above, the annular vortex combustors 200 to 1200 take the inlet flow that would need to be turned to feed conventional swirlers and cooling holes, and incorporate that inlet flow into the primary zone vortex. With respect to point (4), multiple counter rotating vortices spaced axially increase residence time and mixing. With respect to point (5), the driver openings improve mixing, which decreases the pattern factor, and with respect to (6), the tangentially oriented driver openings form the vortices while adding bulk swirl to the flow to benefit the turbine stage one nozzle.

Further aspects are provided by the subject matter of the following clauses.

An annular vortex combustor for a turbine engine defines an upstream end and a downstream end, and comprises a combustor liner including an outer liner, an inner liner, and a dome at the upstream end, the dome having a generally arc shape and extending from the outer liner to the inner liner, and a combustion chamber defined by the outer liner, the inner liner, and the dome, and extending from the upstream end to the downstream end, the combustion chamber having a primary combustion zone defined by the dome, the combustion chamber being configured to combust a mixture of a fuel flow and a compressed air flow in the primary combustion zone to generate a primary zone vortex, the generally arc shape of the dome shaping the primary zone vortex.

The annular vortex combustor of the preceding clause, at least one of the inner liner or the outer liner extending into the combustion chamber as the combustor liner extends axially, such that a volume of the combustion chamber decreases from the primary combustion zone towards the downstream end.

The annular vortex combustor of any preceding clause, the generally arc shape of the dome having an arc that is greater than or equal to 180° and less than 360°.

The annular vortex combustor of any preceding clause, the combustion chamber having a secondary combustion zone that is axially downstream of the primary combustion zone, the secondary combustion zone including a secondary zone vortex that is entirely axially aft of the primary zone vortex.

The annular vortex combustor of any preceding clause, further comprising one or more driver openings extending radially through the combustor liner, the one or more driver openings providing a driver flow formed of the compressed air flow, the driver flow entering the combustion chamber as a wall of air for shaping and driving the primary zone vortex in the combustion chamber.

The annular vortex combustor of any preceding clause, the one or more driver openings including a first driver opening that provides a first driver flow for shaping and driving the primary zone vortex, and a second driver opening that provides a second driver flow for shaping and driving a secondary zone vortex downstream of the primary zone vortex.

The annular vortex combustor of any preceding clause, further comprising a plurality of liner cooling holes extending through the combustor liner for providing a cooling flow of the compressed air flow into the combustion chamber.

The annular vortex combustor of any preceding clause, the plurality of liner cooling holes extending through the dome and are angled to direct the cooling flow tangentially with respect to the dome, to shape the primary zone vortex.

The annular vortex combustor of any preceding clause, further comprising a fuel nozzle assembly that injects the fuel flow into the combustion chamber.

The annular vortex combustor of any preceding clause, the fuel nozzle assembly being configured to inject the fuel flow tangentially with respect to the dome such that the fuel flow shapes the primary zone vortex.

The annular vortex combustor of any preceding clause, wherein the fuel nozzle assembly is configured to inject the fuel flow forward towards the dome.

The annular vortex combustor of any preceding clause, wherein the fuel nozzle assembly is configured to inject the fuel flow aft towards the aft end.

The annular vortex combustor of any preceding clause, wherein the first driver opening is positioned upstream of the primary zone vortex.

The annular vortex combustor of any preceding clause, wherein the second driver opening is positioned upstream of the secondary zone vortex.

The annular vortex combustor of any preceding clause, wherein the primary combustion zone has a maximum radial height $H_{prim}$ defined as a diameter of the combustion chamber at the primary combustion zone in the radial direction at an axial location where the diameter of the primary combustion zone is greatest.

The annular vortex combustor of any preceding clause, wherein the combustion chamber has a first driver hole radial height $H_{d,1}$ defined as a diameter of the combustion chamber in the radial direction at an axial location of an axial center of the first driver opening.

The annular vortex combustor of any preceding clause, wherein the combustion chamber has a second driver hole radial height $H_{d,2}$ defined as a diameter of the combustion chamber in the radial direction at an axial location of an axial center of the second driver opening.

The annular vortex combustor of any preceding clause, wherein the combustion chamber has a primary zone axial distance $X_{prim}$ defined in the axial direction from the dome to the axial center of the first driver opening.

The annular vortex combustor of any preceding clause, wherein the combustion chamber has a first driver opening axial distance $X_{d,1}$ defined in the axial direction from the axial center of the first drive opening to the axial center of the second driver opening.

The annular vortex combustor of any preceding clause, wherein the combustion chamber has an nth driver opening axial distance $X_{d,n}$ of the second driver opening defined in the axial direction from the axial center of the second driver opening to the aft end of the combustion chamber.

The annular vortex combustor of any preceding clause, wherein the first driver flow through the first driver opening has a first driver flow penetration height $H_{j,1}$ defined as the radial height of the first driver flow from the first driver opening into the combustion chamber.

The annular vortex combustor of any preceding clause, wherein the second driver flow has a second driver flow penetration height $H_{j,2}$ defined as the radial height of the second driver flow from the second driver opening into the combustion chamber.

The annular vortex combustor of any preceding clause, wherein the primary zone axial distance $X_{prim}$ is greater than or equal to half of the maximum radial height $H_{prim}$ and less than or equal to two point five times the maximum radial height $H_{prim}$.

The annular vortex combustor of any preceding clause, wherein the first driver hole axial distance $X_{d,1}$ is greater than or equal to a quarter of the first driver opening radial height $H_{d,1}$ and less than or equal to two times the maximum radial height $H_{prim}$.

The annular vortex combustor of any preceding clause, wherein the nth driver hole axial distance $X_{d,n}$ is greater than or equal to a quarter of the nth driver opening radial height $H_{d,n}$.

The annular vortex combustor of any preceding clause, wherein the first driver flow penetration height $H_{j,1}$ is greater than or equal to half of the first driver opening radial height $H_{d,1}$. The second driver flow penetration height $H_{j,2}$ is greater than or equal to half of the second driver opening radial height $H_{d,2}$.

The annular vortex combustor of any preceding clause, wherein the primary zone vortex rotates in a counterclockwise direction.

The annular vortex combustor of any preceding clause, wherein the primary zone vortex rotates in a clockwise direction.

The annular vortex combustor of any preceding clause, wherein the primary zone vortex and the secondary zone vortex are counter rotating.

The annular vortex combustor of any preceding clause, further comprising a diffuser inlet that directs the compressed air flow generally axially towards the combustion chamber.

The annular vortex combustor of any preceding clause, wherein the diffuser inlet directs the compressed air flow generally radially towards the combustion chamber.

The annular vortex combustor of any preceding clause, wherein the annular vortex combustor is angled at a cant angle with respect to the longitudinal centerline axis, the cant angle being greater than zero degrees and less than or equal to ninety degrees.

The annular vortex combustor of any preceding clause, wherein the liner cooling holes that are positioned at the secondary combustion zone include liner cooling holes that angle the cooling flow upstream towards the first driver flow.

The annular vortex combustor of any preceding clause, wherein the outer liner has an outer liner contour that has one or more outer liner curves that curve the outer liner towards the longitudinal centerline axis from the dome towards the aft end.

The annular vortex combustor of any preceding clause, wherein the inner liner has an inner liner contour that has one or more inner liner curves that curve the inner liner towards the longitudinal centerline axis from the dome towards the aft end.

The annular vortex combustor of any preceding clause, wherein the combustor liner converges from the dome to the one or more outer liner curves and the one or more inner liner curves and diverges from the one or more outer liner curves and the one or more inner liner curves such that the combustion chamber is a converging/diverging combustion chamber.

The annular vortex combustor of any preceding clause, wherein the secondary zone vortex is nested within the one or more inner liner curves.

The annular vortex combustor of any preceding clause, wherein the one or more outer liner curves include a hairpin bend such that the outer liner defines a step that is substantially radial into the combustion chamber.

The annular vortex combustor of any preceding clause, wherein an inner angle of the one or more outer liner curves is an acute angle.

The annular vortex combustor of any preceding clause, wherein the one or more inner liner curves include a hairpin bend such that the inner liner defines a step that is substantially radial into the combustion chamber.

The annular vortex combustor of any preceding clause, wherein an inner angle of the one or more inner liner curves is an acute angle.

The annular vortex combustor of any preceding clause, wherein the combustion chamber defines a throat between the step of the outer liner and the step of the inner liner.

The annular vortex combustor of any preceding clause, wherein the fuel nozzle assembly includes a first fuel injector for injecting a first fuel flow into the combustion chamber and a second fuel injector for injecting a second fuel flow into the combustion chamber.

The annular vortex combustor of any preceding clause, wherein the first fuel injector is configured to inject the first fuel flow tangentially into the combustion chamber.

The annular vortex combustor of any preceding clause, wherein the second fuel injector is configured to inject the second fuel flow radially into the combustion chamber.

The annular vortex combustor of any preceding clause, further comprising a plurality of nuggets that define slots in the combustor liner, the plurality of nuggets directs the cooling flow from plurality of liner cooling holes into the combustion chamber.

A turbine engine comprises a compressor section for compressing air flowing therethrough to provide a compressed air flow, and an annular vortex combustor defining an upstream end and a downstream end, and comprising a combustor liner including an outer liner, an inner liner, and a dome at the upstream end, the dome having a generally arc shape and extending from the outer liner to the inner liner, and a combustion chamber defined by the outer liner, the inner liner, and the dome, and extending from the upstream end to the downstream end, the combustion chamber having a primary combustion zone defined by the dome, the combustion chamber being configured to combust a mixture of a fuel flow and the compressed air flow in the primary combustion zone to generate a primary zone vortex, the generally arc shape of the dome shaping the primary zone vortex.

The turbine engine of any preceding clause, at least one of the inner liner or the outer liner extending into the combustion chamber as the combustor liner extends axially, such that a volume of the combustion chamber decreases from the primary combustion zone towards the downstream end.

The turbine engine of any preceding clause, the generally arc shape of the dome having an arc that is greater than or equal to 180° and less than 360°.

The turbine engine of any preceding clause, the combustion chamber having a secondary combustion zone that is axially downstream of the primary combustion zone, the secondary combustion zone including a secondary zone vortex that is entirely axially aft of the primary zone vortex.

The turbine engine of any preceding clause, further comprising one or more driver openings extending radially through the combustor liner, the one or more driver openings providing a driver flow formed of the compressed air flow, the driver flow entering the combustion chamber as a wall of air for shaping and driving the primary zone vortex in the combustion chamber.

The turbine engine of any preceding clause, the one or more driver openings including a first driver opening that provides a first driver flow for shaping and driving the primary zone vortex, and a second driver opening that provides a second driver flow for shaping and driving a secondary zone vortex downstream of the primary zone vortex.

The turbine engine of any preceding clause, further comprising a plurality of liner cooling holes extending through the combustor liner for providing a cooling flow of the compressed air flow into the combustion chamber.

The turbine engine of any preceding clause, the plurality of liner cooling holes extending through the dome and are angled to direct the cooling flow tangentially with respect to the dome, to shape the primary zone vortex.

The turbine engine of any preceding clause, further comprising a fuel nozzle assembly that injects the fuel flow into the combustion chamber.

The turbine engine of any preceding clause, the fuel nozzle assembly being configured to inject the fuel flow tangentially with respect to the dome such that the fuel flow shapes the primary zone vortex.

The turbine engine of any preceding clause, wherein the fuel nozzle assembly is configured to inject the fuel flow forward towards the dome.

The turbine engine of any preceding clause, wherein the fuel nozzle assembly is configured to inject the fuel flow aft towards the aft end.

The turbine engine of any preceding clause, wherein the first driver opening is positioned upstream of the primary zone vortex.

The turbine engine of any preceding clause, wherein the second driver opening is positioned upstream of the secondary zone vortex.

The turbine engine of any preceding clause, wherein the primary combustion zone has a maximum radial height $H_{prim}$ defined as a diameter of the combustion chamber at the primary combustion zone in the radial direction at an axial location where the diameter of the primary combustion zone is greatest.

The turbine engine of any preceding clause, wherein the combustion chamber has a first driver hole radial height $H_{d,1}$ defined as a diameter of the combustion chamber in the radial direction at an axial location of an axial center of the first driver opening.

The turbine engine of any preceding clause, wherein the combustion chamber has a second driver hole radial height $H_{d,2}$ defined as a diameter of the combustion chamber in the radial direction at an axial location of an axial center of the second driver opening.

The turbine engine of any preceding clause, wherein the combustion chamber has a primary zone axial distance $X_{prim}$ defined in the axial direction from the dome to the axial center of the first driver opening.

The turbine engine of any preceding clause, wherein the combustion chamber has a first driver opening axial distance $X_{d,1}$ defined in the axial direction from the axial center of the first drive opening to the axial center of the second driver opening.

The turbine engine of any preceding clause, wherein the combustion chamber has an nth driver opening axial distance $X_{d,n}$ of the second driver opening defined in the axial direction from the axial center of the second driver opening to the aft end of the combustion chamber.

The turbine engine of any preceding clause, wherein the first driver flow through the first driver opening has a first driver flow penetration height $H_{j,1}$ defined as the radial height of the first driver flow from the first driver opening into the combustion chamber.

The turbine engine of any preceding clause, wherein the second driver flow has a second driver flow penetration height $H_{j,2}$ defined as the radial height of the second driver flow from the second driver opening into the combustion chamber.

The turbine engine of any preceding clause, wherein the primary zone axial distance $X_{prim}$ is greater than or equal to half of the maximum radial height $H_{prim}$ and less than or equal to two point five times the maximum radial height $H_{prim}$.

The turbine engine of any preceding clause, wherein the first driver hole axial distance $X_{d,1}$ is greater than or equal to a quarter of the first driver opening radial height $H_{d,1}$ and less than or equal to two times the maximum radial height $H_{prim}$.

The turbine engine of any preceding clause, wherein the nth driver hole axial distance $X_{d,n}$ is greater than or equal to a quarter of the nth driver opening radial height $H_{d,n}$.

The turbine engine of any preceding clause, wherein the first driver flow penetration height $H_{j,1}$ is greater than or equal to half of the first driver opening radial height $H_{d,1}$. The second driver flow penetration height $H_{j,2}$ is greater than or equal to half of the second driver opening radial height $H_{d,2}$.

The turbine engine of any preceding clause, wherein the primary zone vortex rotates in a counterclockwise direction.

The turbine engine of any preceding clause, wherein the primary zone vortex rotates in a clockwise direction.

The turbine engine of any preceding clause, wherein the primary zone vortex and the secondary zone vortex are counter rotating.

The turbine engine of any preceding clause, further comprising a diffuser inlet that directs the compressed air flow generally axially towards the combustion chamber.

The turbine engine of any preceding clause, wherein the diffuser inlet directs the compressed air flow generally radially towards the combustion chamber.

The turbine engine of any preceding clause, wherein the annular vortex combustor is angled at a cant angle with respect to the longitudinal centerline axis, the cant angle being greater than zero degrees and less than or equal to ninety degrees.

The turbine engine of any preceding clause, wherein the liner cooling holes that are positioned at the secondary combustion zone include liner cooling holes that angle the cooling flow upstream towards the first driver flow.

The turbine engine of any preceding clause, wherein the outer liner has an outer liner contour that has one or more outer liner curves that curve the outer liner towards the longitudinal centerline axis from the dome towards the aft end.

The turbine engine of any preceding clause, wherein the inner liner has an inner liner contour that has one or more inner liner curves that curve the inner liner towards the longitudinal centerline axis from the dome towards the aft end.

The turbine engine of any preceding clause, wherein the combustor liner converges from the dome to the one or more outer liner curves and the one or more inner liner curves and diverges from the one or more outer liner curves and the one or more inner liner curves such that the combustion chamber is a converging/diverging combustion chamber.

The turbine engine of any preceding clause, wherein the secondary zone vortex is nested within the one or more inner liner curves.

The turbine engine of any preceding clause, wherein the one or more outer liner curves include a hairpin bend such that the outer liner defines a step that is substantially radial into the combustion chamber.

The turbine engine of any preceding clause, wherein an inner angle of the one or more outer liner curves is an acute angle.

The turbine engine of any preceding clause, wherein the one or more inner liner curves include a hairpin bend such that the inner liner defines a step that is substantially radial into the combustion chamber.

The turbine engine of any preceding clause, wherein an inner angle of the one or more inner liner curves is an acute angle.

The turbine engine of any preceding clause, wherein the combustion chamber defines a throat between the step of the outer liner and the step of the inner liner.

The turbine engine of any preceding clause, wherein the fuel nozzle assembly includes a first fuel injector for injecting a first fuel flow into the combustion chamber and a second fuel injector for injecting a second fuel flow into the combustion chamber.

The turbine engine of any preceding clause, wherein the first fuel injector is configured to inject the first fuel flow tangentially into the combustion chamber.

The turbine engine of any preceding clause, wherein the second fuel injector is configured to inject the second fuel flow radially into the combustion chamber.

The turbine engine of any preceding clause, wherein the annular vortex combustor further comprises a plurality of nuggets that define slots in the combustor liner, the plurality of nuggets directs the cooling flow from plurality of liner cooling holes into the combustion chamber.

Although the foregoing description is directed to the preferred embodiments of the present disclosure, other variations and modifications will be apparent to those skilled in the art and may be made without departing from the disclosure. Moreover, features described in connection with one embodiment of the present disclosure may be used in conjunction with other embodiments, even if not explicitly stated above.

The invention claimed is:

1. An annular vortex combustor for a turbine engine, the annular vortex combustor defining a forward end and an aft end, and comprising:

a combustor liner including an outer liner, an inner liner, and a dome at the forward end, the dome having an arc shape that extends from the outer liner to the inner liner with a radius of curvature that is greater than or equal to 180° and less than 360°;

a combustion chamber defined by the outer liner, the inner liner, and the dome, and extending from the forward end to the aft end, the combustion chamber having a primary combustion zone defined by the dome, wherein the combustion chamber is configured to combust a mixture of a fuel flow and a compressed air flow in the primary combustion zone to generate a primary zone vortex, the arc shape of the dome shaping the primary zone vortex in a vortex direction;

a plurality of liner cooling holes extending through the dome, each of the plurality of liner cooling holes angled to direct a cooling flow in a same circumferential direction along the dome and tangentially with respect to the dome and in the vortex direction to shape the primary zone vortex in the vortex direction; and a first driver opening and a second driver opening extending radially through the combustor liner and positioned axially aft of the dome and downstream of the primary combustion zone such that the primary combustion zone extends axially from the forward end to the first driver opening, the first driver opening and the second driver opening each oriented at an angle in a downstream direction for providing a driver flow formed of the compressed air flow for shaping and driving the primary zone vortex in the combustion chamber, wherein the first driver opening and the second driver opening are axially staggered from each other, wherein the first driver opening extends radially through one of the inner liner or the outer liner, and the second driver opening extends radially through the other of the inner liner or the outer liner, and wherein the first driver opening and the second driver opening are configured to form two axially-spaced counter-rotating toroidal vortices in the combustion chamber including the primary zone vortex and a secondary zone vortex.

2. The annular vortex combustor of claim 1, wherein at least one of the inner liner or the outer liner extends into the combustion chamber as the combustor liner extends axially, such that a volume of the combustion chamber decreases from the primary combustion zone towards the aft end.

3. The annular vortex combustor of claim 1, wherein the combustion chamber has a secondary combustion zone that is axially downstream of the primary combustion zone, the secondary combustion zone including the secondary zone vortex that is entirely axially aft of the primary zone vortex.

4. The annular vortex combustor of claim 1, wherein the secondary zone vortex is downstream of the primary zone vortex.

5. The annular vortex combustor of claim 4, wherein the secondary zone vortex is disposed in a secondary combustion zone that extends from the first driver opening to the second driver opening.

6. The annular vortex combustor of claim 4, wherein the secondary zone vortex is entirely axially aft of the primary zone vortex.

7. The annular vortex combustor of claim 1, wherein the plurality of liner cooling holes extend through the combustor liner for providing a cooling flow of the compressed air flow into the combustion chamber.

8. The annular vortex combustor of claim 1, further comprising a fuel nozzle assembly that injects the fuel flow into the combustion chamber.

9. The annular vortex combustor of claim 8, wherein the fuel nozzle assembly is configured to inject the fuel flow tangentially with respect to the dome and in the vortex direction such that the fuel flow shapes the primary zone vortex.

10. The annular vortex combustor of claim 1, wherein the combustion chamber has a first driver hole radial height defined as a diameter of the combustion chamber in a radial direction at an axial location of an axial center of the first driver opening, the first driver opening being sized and oriented to provide a penetration of the driver flow into the combustion chamber at a first driver flow penetration height that is greater than or equal to half of the first driver opening radial height.

11. A turbine engine comprising:

a compressor section for compressing air flowing therethrough to provide a compressed air flow; and an annular vortex combustor defining a forward end and an aft end, and comprising:

a combustor liner including an outer liner, an inner liner, and a dome at the forward end, the dome having an arc shape that extends from the outer liner to the inner liner with a radius of curvature that is greater than or equal to 180° and less than 360°;

a combustion chamber defined by the outer liner, the inner liner, and the dome, and extending from the forward end to the aft end, the combustion chamber having a primary combustion zone defined by the dome, wherein the combustion chamber is configured to combust a mixture of a fuel flow and the compressed air flow in the primary combustion zone to generate a primary zone vortex, the arc shape of the dome shaping the primary zone vortex in a vortex direction;

a plurality of liner cooling holes extending through the dome, each of the plurality of liner cooling holes angled to direct a cooling flow in a same circumferential direction along the dome and tangentially with respect to the dome and in the vortex direction to shape the primary zone vortex in the vortex direction; and a first driver opening and a second driver opening extending radially through the combustor liner and positioned axially aft of the dome and downstream of the primary combustion zone such that the primary combustion zone extends axially from the forward end to the first driver opening, the first driver opening and the second driver opening each oriented at an angle in a downstream direction for providing a driver flow formed of the compressed air flow for shaping and driving the primary zone vortex in the combustion chamber, wherein the first driver opening and the second driver opening are axially staggered from each other, wherein the first driver opening extends radially through one of the inner liner or the outer liner, and the second driver opening extends radially through the other of the inner liner or the outer liner, and wherein the first driver opening and the second driver opening are configured to form two axially-spaced counter-rotating toroidal vortices in the combustion chamber including the primary zone vortex and a secondary zone vortex.

12. The turbine engine of claim 11, wherein at least one of the inner liner or the outer liner extends into the combustion chamber as the combustor liner extends axially, such that a volume of the combustion chamber decreases from the primary combustion zone towards the aft end.

13. The turbine engine of claim 11, wherein the combustion chamber has a secondary combustion zone that is axially downstream of the primary combustion zone, the secondary combustion zone including the secondary zone vortex that is entirely axially aft of the primary zone vortex.

14. The turbine engine of claim 11, wherein the secondary zone vortex is downstream of the primary zone vortex.

15. The turbine engine of claim 14, wherein the secondary zone vortex is disposed in a secondary combustion zone that extends from the first driver opening to the second driver opening.

16. The turbine engine of claim 14, wherein the secondary zone vortex is entirely axially aft of the primary zone vortex.

17. The turbine engine of claim 11, wherein the plurality of liner cooling holes extend through the combustor liner for providing a cooling flow of the compressed air flow into the combustion chamber.

18. The turbine engine of claim 11, further comprising a fuel nozzle assembly that injects the fuel flow into the combustion chamber.

19. The turbine engine of claim 18, wherein the fuel nozzle assembly is configured to inject the fuel flow tangentially with respect to the dome such that the fuel flow shapes the primary zone vortex.

20. The turbine engine of claim 11, wherein the combustion chamber has a first driver hole radial height defined as a diameter of the combustion chamber in a radial direction at an axial location of an axial center of the first driver opening, the first driver opening being sized and oriented to provide a penetration of the driver flow into the combustion chamber at a first driver flow penetration height that is greater than or equal to half of the first driver opening radial height.

* * * * *